US009500360B2

(12) United States Patent
Akinaga et al.

(10) Patent No.: US 9,500,360 B2
(45) Date of Patent: Nov. 22, 2016

(54) CLOSED DRAIN RECOVERY SYSTEM

(75) Inventors: Sohei Akinaga, Ehime (JP); Tomohiro Ookubo, Ehime (JP); Tatsuki Kobayashi, Ehime (JP); Hiroyuki Hatanaka, Ehime (JP)

(73) Assignee: MIURA CO., LTD., Ehime (JP)

( * ) Notice: Subject to any disclaimer, the term of this patent is extended or adjusted under 35 U.S.C. 154(b) by 127 days.

(21) Appl. No.: 14/387,805

(22) PCT Filed: Apr. 27, 2012

(86) PCT No.: PCT/JP2012/061378
§ 371 (c)(1),
(2), (4) Date: Sep. 24, 2014

(87) PCT Pub. No.: WO2013/145335
PCT Pub. Date: Oct. 3, 2013

(65) Prior Publication Data

US 2015/0027384 A1 Jan. 29, 2015

(30) Foreign Application Priority Data

Mar. 29, 2012 (JP) ..... 2012-076025

(51) Int. Cl.

| | |
|---|---|
| ***F16T 1/48*** | (2006.01) |
| ***F22D 11/06*** | (2006.01) |
| ***F22D 1/28*** | (2006.01) |
| ***F28B 1/02*** | (2006.01) |

(52) U.S. Cl.
CPC ..... *F22D 11/06* (2013.01); *F22D 1/28* (2013.01); *F28B 1/02* (2013.01)

(58) Field of Classification Search
CPC ..... F01K 9/00; F01K 23/10; F28B 9/08; F22B 1/284; F16T 1/48
USPC ..... 122/406.1, 442, 443, 414, 415, 459
See application file for complete search history.

(56) References Cited

U.S. PATENT DOCUMENTS 4,177,767 A * 12/1979 Regamey ..... F01K 9/023 122/1 R
5,262,091 A * 11/1993 Narabayashi ..... F04F 5/461 261/21

(Continued)

FOREIGN PATENT DOCUMENTS

| | | |
|---|---|---|
| JP | 62-5003 A | 1/1987 |
| JP | 4-49711 U | 4/1992 |
| JP | 2002-316145 A | 10/2002 |

(Continued)

*Primary Examiner* — Gregory A Wilson
(74) *Attorney, Agent, or Firm* — Muncy, Geissler, Olds & Lowe, P.C.

(57) ABSTRACT

To achieve a downsized drain tank without reducing an effective drain recovery rate. A closed drain recovery system includes: a steam boiler (2); a closed-type drain tank (4); an air-open-type makeup water tank (7); a steam introduction line (10) for introducing a first flush steam within the drain tank (4) to the makeup water tank (7); a surplus drain introduction line (8) for introducing surplus drain to the makeup water tank (7) from the drain tank (4); and condensing units (33) and (39) provided for the makeup water tank (7), and configured to condense one or both of the first flush steam and a second flush steam by bringing the one or both of the first flush steam and the second flush steam into contact with the makeup water within the makeup water tank (7), the second flush steam being generated from the surplus drain.

6 Claims, 16 Drawing Sheets

(56) References Cited

U.S. PATENT DOCUMENTS

| | | | | |
|---|---|---|---|---|
| 2014/0345274 | A1* | 11/2014 | Ernst | F01K 9/00 60/614 |
| 2015/0211731 | A1* | 7/2015 | Young | F22D 5/00 290/52 |

FOREIGN PATENT DOCUMENTS

| | | | |
|---|---|---|---|
| JP | 2001-004786 | A | 1/2004 |
| JP | 2006-105442 | A | 4/2006 |
| JP | 2009-150603 | A | 7/2009 |
| JP | 2012-002384 | A | 1/2012 |

* cited by examiner

CLOSED DRAIN RECOVERY SYSTEM

TECHNICAL FIELD

The present invention relates to a drain recovery system capable of recovering high-temperature drain generated by a loading apparatus into a drain tank, and supplying the recovered drain to a steam boiler to utilize the drain. The present invention is based on and claims the benefit of priority from JP 2012-076025 filed on Mar. 29, 2012 in Japan, the disclosure of which is incorporated herein by reference.

BACKGROUND ART

As a drain recovery system of this type, an open drain recovery system as described in Patent Literature 1 in which drain is utilized by recovering the drain in an air-open-type drain tank and supplying the drain to a steam boiler is known. According to this open drain recovery system, an effective drain recovery rate is up to 40% to 50% at a maximum, as a large amount of flush steam is generated when high-temperature and high-pressure drain flows into the drain tank. Therefore, as in Patent Literature 1, various attempts have been made in order to recover the flush steam. However, an effective drain recovery rate of an entire system is limited despite such attempts. Here, the effective drain recovery rate is defined as "(returned drain amount−amount of flush steam released into air)/returned drain amount".

As a method that fundamentally solves this problem, a closed drain recovery system as described in Patent Literature 2 in which drain is utilized by recovering the drain in a closed-type drain tank and supplying the drain to a steam boiler has been known. This closed drain recovery system can improve the effective drain recovery rate, as it prevents flush steam generated in the drain tank from being released into air without recovering heat. Further an improvement of the recovery rate is expected by increasing a content of the drain tank against the returned drain amount.

CITATION LIST

Patent Literature

Patent Literature 1: JP 2009-150603 A
Patent Literature 2: JP 2006-105442 A

SUMMARY OF INVENTION

Technical Problems

However, increasing the content of the drain tank of the closed drain recovery system also increases both a space required for installing the system and an initial cost of the system, and therefore downsizing of the drain tank becomes a task.

When the drain tank is downsized, it is not possible to store all of the returned drain in the drain tank if an amount of returned drain per unit time increases due to load fluctuation, and it is necessary to let out the surplus drain to an air-open-type makeup water tank or to release flush steam generated in the drain tank (including pressurized steam in the drain tank) to a makeup water tank. Further, the drain tank releases flush steam generated when self-pressurized water delivery of the drain to the makeup water tank. There is a problem unique to a closed drain recovery system that heat of these surplus drain and flush steam may not be fully recovered when released to the makeup water tank, and thus the effective drain recovery rate decreases.

An object of the present invention is to provide a closed drain recovery system capable of downsizing a drain tank without reducing an effective drain recovery rate.

Solution to Problem

The present invention has been made in order to solve the above problem. The invention provides a closed drain recovery system including:

a steam boiler configured to supply steam to a loading apparatus;

a closed-type drain tank for reserving drain discharged from the loading apparatus through a drain return line, and configured to supply the reserved drain to the steam boiler through a drain supply line;

an air-open-type makeup water tank configured to supply makeup water to the drain tank through a makeup water line;

a steam introduction line for introducing a first flush steam within the drain tank to the makeup water tank;

a surplus drain introduction line for introducing surplus drain to the makeup water tank from one of the drain tank and the loading apparatus; and a condensing unit provided for the makeup water tank, and configured to condense one or both of the first flush steam and a second flush steam by bringing the one or both of the first flush steam and the second flush steam into contact with the makeup water within the makeup water tank, the second flush steam being generated from the surplus drain.

According to the invention, the one or both of the first flush steam and a second flush steam is condensed by the condensing unit by bringing the one or both of the first flush steam and the second flush steam into contact with the makeup water within the makeup water tank, the second flush steam being generated from the surplus drain. Therefore, it is possible to downsize the drain tank while preventing an effective drain recovery rate from reducing due to the flush steam released into the air.

Further, the condensing unit brings the makeup water into contact with the one or both of the first flush steam and the second flush steam while causing the makeup water to be circulated within the makeup water tank.

According to the invention, the temperature of the makeup water within the makeup water tank may be equalized at a temperature lower than 100° C. to allow contact with water at a relatively low temperature. Therefore, it is possible to provide effects of condensing a greater amount of flush steam and further downsizing the drain tank.

Further, the invention provides the closed drain recovery system, in which the condensing unit includes mixer means and circulation means, the mixer means includes:

a sprinkler;

a mixer configured to condense the one or both of the first flush steam and the second flush steam by bringing the one or both of the first flush steam and the second flush steam into contact with the makeup water sprinkled from the sprinkler; and a water introduction unit configured to introduce the water condensed by the mixer into a liquid phase unit of the makeup water tank, and the circulation means includes:

a circulation pump; and a circulation line configured to introduce the makeup water at a bottom of the makeup water tank to the sprinkler.

According to the invention, it is possible to provide effects of efficiently condensing the flush steam by making it easier to bring the flush steam and makeup water into contact with each other by the mixer means, and further downsizing the drain tank.

The invention provides the closed drain recovery system, in which the mixer is provided with a contact heat exchange member for exchanging contact heat between the makeup water and the flush steam.

According to the invention, it is possible to provide effects of improving the contact efficiency between the flush steam and the makeup water, further efficiently condensing flush steam, and even further downsizing the drain tank.

The invention provides the closed drain recovery system, including:

the steam introduction line; and the surplus drain introduction line, wherein the condensing unit is provided for a connecting unit of the makeup water tank with the steam introduction line and the surplus drain introduction line.

According to the invention, it is possible to provide effects of condensing the first flush steam and the second flush steam, and even further downsizing the drain tank.

The invention also provides the closed drain recovery system, including:

a first valve that is openable and closable and provided for the drain return line;

the surplus drain introduction line connected between the drain return line on an upstream side of the first valve and the makeup water tank; and a second valve that is openable and closable and provided for the surplus drain introduction line, wherein one of a first open-close state and a second open-close state is selectable, the first open-close state being a state in which the first valve is opened and the second valve is closed, the second open-close state being a state in which the first valve is closed and the second valve is opened, and the surplus drain is introduced into the makeup water tank in the second open-close state.

According to the invention, it is possible to provide effects that when the drain tank cannot store the drain, the second flush steam generated by introduction of the drain into the makeup water tank may be condensed by bringing a state into the second open-close state, and that the drain tank is even further downsized.

Further, the invention provides the closed drain recovery system, in which the condensing unit provided for the surplus drain introduction line includes a steam separator disposed under the contact heat exchange member of the mixer, the steam separator being configured to separate steam by causing surplus drain that has flowed in to be hit against a separating plate.

According to the invention, it is possible to provide effects of effectively separating the steam from the drain in the two-phase flow of the surplus drain introduction line, promoting the condensing by the contact between the separated steam and the makeup water, and even further downsizing the drain tank.

Advantageous Effects of Invention

According to the present invention, a closed drain recovery system capable of downsizing a drain tank without reducing an effective drain recovery rate may be provided.

DESCRIPTION OF EMBODIMENT

Figure 1:
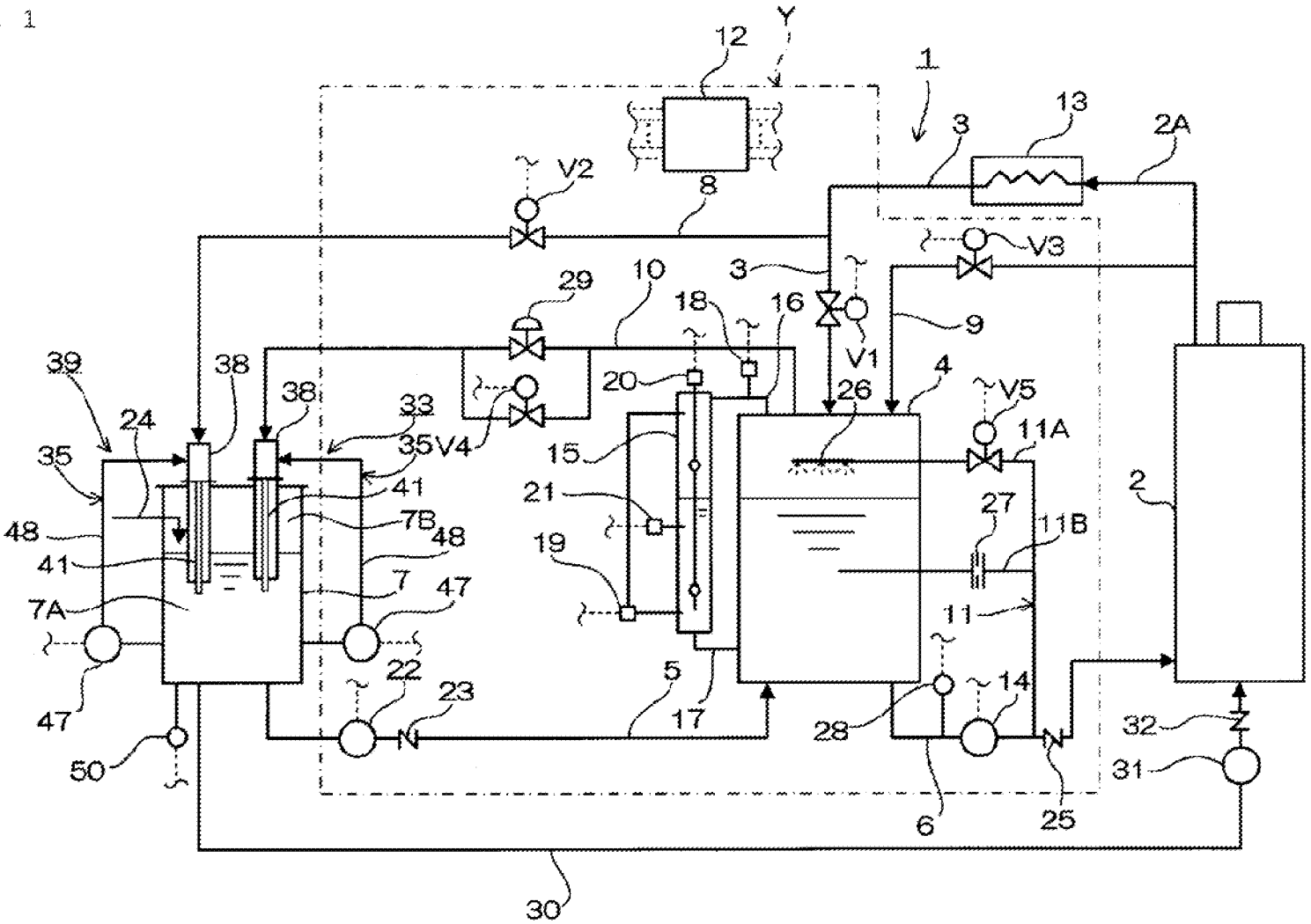
FIG. 1 is a general configuration diagram illustrating a first embodiment of a drain recovery system implementing the present invention.

Hereinafter, an embodiment of the present invention will be described. The embodiment of the present invention may be suitably implemented in a closed drain recovery system (hereinafter, simply referred to as a drain recovery system if it is not necessary to differentiate from an open drain recovery system) that utilizes drain recovered from a loading apparatus as a steam using apparatus of a steam boiler by supplying the recovered drain to the steam boiler.

The embodiment will be described specifically. The drain recovery system according to the embodiment includes: a steam boiler configured to supply steam to a loading apparatus; a closed-type drain tank for reserving drain discharged from the loading apparatus through a drain return line, and configured to supply the reserved drain to the steam boiler through a drain supply line; and an air-open-type makeup water tank configured to supply makeup water to the drain tank through a makeup water line.

The drain recovery system further includes: a steam introduction line for introducing a first flush steam within the drain tank to the makeup water tank; and a surplus drain introduction line for introducing surplus drain to the makeup water tank from one of the drain tank and the loading apparatus. The surplus drain refers to drain introduced from the drain tank to the makeup water tank in such a case in which a water level within the drain tank exceeds a setting water level. The steam introduction line is provided with a valve that opens when a pressure within the drain tank exceeds a setting pressure or when the water level within the drain tank exceeds the setting water level.

When the drain from the loading apparatus flows into the drain tank in which a pressure is lower than that of the drain and exceeds the atmospheric pressure, flush steam is generated within the drain tank. This flush steam is referred to as a first flush steam. An amount of the first flush steam increases as the size of the drain tank is reduced. According to the present application, the description is given assuming that the first flush steam includes pressurized steam introduced from the steam boiler to the drain tank in order to increase the pressure within the drain tank to a predetermined pressure.

The surplus drain introduction line includes the following two modes. In the first mode, there is provided indirect surplus drain recovery means for introducing the surplus drain to the makeup water tank through the drain tank. In the second mode, there is provided direct surplus drain recovery means for introducing the surplus drain to the makeup water tank through the drain return line without passing through the drain tank. The surplus drain introduction line includes an on-off valve configured to regulate the flow of the surplus drain to the makeup water tank. Further, the drain return line of the indirect recovery means includes an on-off valve configured to regulate the flow of the drain to the drain tank.

In either mode, when the surplus drain whose pressure is higher than the atmospheric pressure is introduced into the makeup water tank through the surplus drain introduction line, the surplus drain is brought into contact with the makeup water within the makeup water tank at the atmospheric pressure or air to generate flush steam. This flush steam is referred to as a second flush steam. An amount of the second flush steam increases as an amount of the surplus drain increases, along with the downsizing of the drain tank.

Further, the embodiment is characterized in that the makeup water tank includes a condensing unit, and configured to condense the first flush steam and the second flush steam by bringing the first flush steam and the second flush steam into contact with the makeup water within the makeup water tank, the second flush steam being generated from the surplus drain. The condensing unit is preferably configured by a first condensing unit configured to condense the first flush steam and a second condensing unit configured to condense the second flush steam separately from each other, but may be configured as a single condensing unit.

According to the embodiment, the first flush steam and the second flush steam are condensed by the condensing unit by being brought into contact with the makeup water, and recovered as the makeup water in the makeup water tank. Therefore, it is possible to decrease the content of and downsize the drain tank as compared with a system without a condensing unit, assuming that an amount of the returned drain is the same. It should be noted that according to the embodiment of the present invention, the flush steam generated when the first flush steam and/or the second flush steam is brought into contact with the makeup water is assumed to be included in the first flush steam and/or the second flush steam.

According to the drain recovery system of the embodiment, one of the first condensing unit and the second condensing unit may not be provided. In this case, one of the condensing units corresponding to one of the first flush steam and the second flush steam whose amount of generation is smaller is omitted. With this, an amount of recovery of the flush steam of an entire system may be increased. Increasing a recovery rate of the flush steam results in downsizing of the drain tank.

According to the embodiment, the condensing unit is preferably configured to bring the makeup water into contact with the one or both of the first flush steam and the second flush steam while causing the makeup water to be circulated within the makeup water tank to mix. As one mode of circulating the makeup water within the makeup water tank, the makeup water is preferably circulated through a circulation line having one end connected to a bottom of the makeup water tank, the other end connected to a contact mixer with the flush steam, and a circulation pump.

When the makeup water within the makeup water tank is not circulated, the temperature of a portion of the makeup water in contact with the first flush steam and/or the second flush steam becomes high. If the temperature increases up to 100° C. or above, it is not possible to condense and recover the flush steam. By bringing the flush steam into contact with the makeup water while circulating the makeup water, the temperature of the makeup water within the makeup water tank may be equalized at a relatively low temperature lower than 100° C., and it is possible to condense and recover a greater amount of flush steam. It should be noted that, by mixing the first flush steam with the makeup water by bringing these into contact with each other by the first condensing unit to introduce into the makeup water tank, it is possible to more reliably bring the first flush steam into contact with low temperature water in the tank as compared to the configuration in which the first flush steam is directly introduced to the makeup water within the makeup water tank.

Further, according to the embodiment, the condensing unit preferably includes mixer means and circulation means. Moreover, the mixer means includes: a sprinkler configured to sprinkle the makeup water; a mixer (also referred to as a contact mixer) configured to condense the one or both of the first flush steam and the second flush steam by bringing the one or both of the first flush steam and the second flush steam into contact with the makeup water sprinkled from the sprinkler; and a water introduction unit configured to introduce the water condensed by the mixer into a liquid phase unit of the makeup water tank. In addition, the circulation means includes: a circulation pump; and a circulation line configured to introduce the makeup water at a bottom of the makeup water tank to the sprinkler.

With such a configuration, by a water sprinkling function of the sprinkler of the mixer means, it is possible to cause the flush steam and the makeup water to be easily brought into contact with each other, and to efficiently condense the flush steam. Examples of the sprinkler include those ejecting the makeup water like shower or mist.

In the preferred embodiment, the mixer of the second condensing unit may be provided with a second sprinkler configured to sprinkle the drain. With such a configuration, possibility that the drain and the makeup water are brought into contact with each other within the mixer increases, and it is possible to cause the second flush steam generated therefrom and the makeup water to be easily brought into contact with each other, and to efficiently condense the second flush steam.

Further, according to the embodiment, the mixer is preferably provided with a contact heat exchange member for promoting contact between the makeup water and the flush steam (also referred to as a contact heat exchange promoting member). Then, it is configured such that the makeup water from the first sprinkler is introduced to the contact heat exchange member from above the contact heat exchange member, and the flush steam is introduced to the contact heat exchange member from bottom of the contact heat exchange member.

The contact heat exchange member has air and water permeability, and has a function of promoting contact heat exchange between the makeup water sprinkled and the flush steam inside, and preferably configured by a demister. Here, the demister is a component configured to atomize the makeup water by a mesh-like member to increase contact area with the flush steam as well as to decrease a falling velocity of the makeup water. It should be appreciated that the contact heat exchange member is not limited to the demister, and an eliminator used for a cooling tower and having the same function as the demister may be used.

In the preferred embodiment, mist-like makeup water is collected from the sprinkler by the contact heat exchange member, and its falling velocity decreases. This increases the possibility that the drain and the makeup water are brought into contact with the flush steam, and it is possible to effectively cool and condense of the flush steam.

Further, according to the embodiment, the direct surplus drain recovery means may preferably include: a first valve that is openable and closable and provided for the drain return line; the surplus drain introduction line connected between the drain return line on an upstream side of the first valve and the makeup water tank; and a second valve that is openable and closable and provided for the surplus drain introduction line. Further, one of a first open-close state and a second open-close state is selectable, the first open-close state being a state in which the first valve is opened and the second valve is closed, the second open-close state being a state in which the first valve is closed and the second valve is opened, and the surplus drain is introduced into the makeup water tank in the second open-close state via the condensing unit.

By providing the direct surplus drain recovery means, the surplus drain that may not be stored within the drain tank may be introduced to the makeup water tank without passing through the drain tank by selecting the second open-close state in an abnormal case in which it is not possible to store the drain in the drain tank. As a result, it is possible to downsize the drain tank as compared to the system in which the surplus drain is directly introduced to the drain tank. In addition, the condensing unit condenses the second flush steam generated by the introduction, and thus the second flush steam may be recovered.

Preferably, in the embodiment having the configuration in which the surplus drain is directly recovered, the condensing unit provided for the surplus drain introduction line includes a steam separator disposed under the contact heat exchange member of the mixer and configured to separate steam by causing surplus drain that has flowed in to be hit against a separating plate. By such a configuration, as the drain that is a two-phase flow of the steam and the drain that flows through the surplus drain introduction line is hit against the separating plate, it is possible to effectively separate the steam from the drain. As a result, condensation is promoted by bringing the separated steam into contact with the makeup water.

According to the embodiment described above, preferably, the first flush steam within the drain tank may be recovered within the drain tank by sprinkling relatively low temperature drain at the bottom within the drain tank over a gaseous phase unit in the drain tank to bring the drain into contact with the gaseous phase unit.

Further, according to the embodiment, it is possible to provide a pressurized steam line having a pressure valve that opens or closes according to a pressure within the drain tank and for supplying pressurized steam of a pressure above the atmospheric pressure to the drain tank from the steam boiler (including a steam header provided at an outlet of the steam of the steam boiler). The pressure valve is a valve that mechanically opens or closes according to the pressure, or that electrically opens or closes by a pressure sensor. The pressure valve may also be a single valve having a function for adjusting an amount of supplied steam or a pressure of the supplied steam and a function of blocking the steam, or may be configured by a valve that adjusts an amount of the supplied steam or a pressure of the supplied steam and a valve that blocks the steam. By providing such a pressurized steam line, it is possible to supply the steam to the drain tank to maintain a pressure no lower than a saturated pressure, and thus the first flush steam may be reduced.

Here, the components that constitute the drain recovery system of the embodiment according to the present invention will be described. The steam boiler and the loading apparatus are not limited to any specific type or structure.

Further, the drain tank is not limited to a specific structure as long as it is closed type. The makeup water tank is not limited to a specific structure as long as it is open type.

Moreover, a motor valve, a solenoid valve, or an air-driven valve may be used as the on-off valve provided for the surplus drain introduction line or the drain return line.

First Embodiment

Hereinafter, a drain recovery system 1 of a first embodiment according to the present invention will be described with reference to FIG. 1 to FIG. 10.

<Configuration of First Embodiment>

The drain recovery system 1 of the first embodiment includes, as main components, a steam boiler 2, a drain return line 3, a drain tank 4, a makeup water line 5, a drain supply line 6, a makeup water tank 7, a drain relief line 8 as a surplus drain introduction line, a pressurized steam line 9, a pressure relief line (also referred to as a steam relief line) 10 as a steam introduction line, a drain circulation line 11, and a controller 12 as control means. The steam boiler 2 is configured to supply steam to the loading apparatus 13 that uses the steam through a steam supply line 2A. In FIG. 1, a portion encircled by an alternate long and short dash line Y is integrally configured as a drain recovery apparatus.

The drain return line 3 is configured to supply drain discharged from a loading apparatus 13 to the drain tank 4 via a steam trap (not depicted), and includes a first valve V1 as a drain return valve configured by a normally-closed motor valve.

The drain tank 4 is configured as a closed-type, and is configured to supply reserved drain to the steam boiler 2 through the drain supply line 6 having a drain pump 14. To the drain tank 4, a water gauge 15 is connected via a first communication pipe 16 that communicates between gaseous phase units and via a second communication pipe 17 that communicates between liquid phase units. The first communication pipe 16 is provided with a pressure sensor 18 as a first pressure detector configured to detect a pressure within the drain tank 4. The pressure sensor 18 may be provided for the drain tank 4 or the liquid phase unit (or the gaseous phase unit) of the water gauge 15.

Further, the water gauge 15 includes a differential pressure type water level sensor 19 as a first water level detector configured to detect a water level within the water gauge 15, a float switch 20 as a second water level detector configured to detect an abnormal water level for backing up the water level sensor 19, and an on-off switch type pressure switch 21 as a second pressure detector configured to detect an abnormal pressure for backing up the pressure sensor 18. The pressure switch 21 may be provided for the drain tank 4. There may be provided more than one pressure switch.

The makeup water line 5 includes a makeup water pump 22 and a first check valve 23 configured to block the flow toward the makeup water tank 7, configured to supply the makeup water reserved within the air-open-type makeup water tank 7 to the drain tank 4. Over an upper surface of a liquid phase unit 7A within the makeup water tank 7, a re-dissolve protecting member (not depicted) such as beads for preventing the makeup water from being brought into contact with air to be re-dissolved floats.

The makeup water tank 7 includes a makeup water replenish line 24 configured to supply degassed water (or non-degassed water), and a flow rate of the makeup water replenish line 24 is adjusted by a water level detector that is not depicted so that the water level within the makeup water tank 7 is maintained at a setting water level.

The drain supply line 6 is provided with the drain pump 14, and a second check valve 25 configured to block the flow toward the drain pump 14. Further, the drain circulation line 11 (including a part of the drain supply line 6) configured to circulate the drain within the drain tank 4 is provided between the drain supply line 6 on an outlet side of the drain pump 14 and the drain tank 4. An amount of circulation through the drain circulation line 11 is equal to or greater than a minimum flow rate (minimum flow) which is a minimum required flow rate for cooling the drain pump 14.

The drain circulation line 11 is provided with a first circulation line 11A including a spray pipe (may be referred to as a spray portion) 26 as a spray unit having a nozzle for spraying mist-like drain over the gaseous phase unit within the drain tank 4, and a second circulation line 11B through which the drain is returned to the liquid phase unit within the drain tank 4. The first circulation line 11A includes a fifth valve V5 configured by a motor valve, and the second circulation line 11B includes an orifice 27 as a circulation resistance for adjusting a flow rate (minimum flow) of the second circulation line 11B when the fifth valve V5 is closed. Further, a first temperature sensor 28 as a first temperature sensor configured to detect a temperature of the drain to be supplied to the steam boiler 2 is provided at a suitable position (in the first embodiment, somewhere along the drain supply line 6 between the drain tank 4 and the drain pump 14) along a flow channel (including a portion within the drain tank 4 and the drain supply line 6) that constitutes the second circulation line 11B.

The drain relief line 8 serves to introduce surplus drain from the loading apparatus 13 to the makeup water tank 7. The surplus drain refers to drain that may not be stored within the drain tank 4 for some reason. The drain relief line 8 connects an upstream side of the first valve V1 of the drain return line 3 and the makeup water tank 7, and is provided with a second valve V2 as a drain relief valve configured by a normally-open motor valve.

The pressurized steam line 9 connects the steam supply line 2A which is a steam outlet from the steam boiler 2 and the drain tank 4, and is provided with a third valve V3 configured by a motor valve as a pressure valve. Here, on a primary side of the third valve V3, a pressure reducing valve (not depicted) is provided as needed.

The pressure relief line 10 has a function of introducing the first flush steam within the drain tank 4 to the makeup water tank 7. The first flush steam is flush steam generated when the drain from the loading apparatus 13 flows into the drain tank 4. The first flush steam is not differentiated from the pressurized steam that is introduced into the drain tank 4 through the pressurized steam line 9, and therefore the first flush steam is assumed to include the pressurized steam in the present invention.

The pressure relief line 10 connects the gaseous phase unit of the drain tank 4 and the makeup water tank 7, and is provided with a pressure regulation valve 29 as a pressure relief valve that opens at the set pressure and above, and a fourth valve V4 configured by a motor valve connected in parallel with the pressure regulation valve 29. The fourth valve V4 is an on-off valve that, by the action of the pressure sensor 18, opens at an operating pressure (second operating pressure) that is higher than an operating pressure (first operating pressure) of the pressure regulation valve and closes at a pressure lower than the second operating pressure by a differential, and by the action of the pressure switch 21, closes at an operating pressure (third operating pressure) that is higher than the second operating pressure and opens at a pressure lower than the third operating pressure by a differential. The first operating pressure, a second operating pressure PH, and a third operating pressure PHH are, for example, but not limited to, 0.78 MPa, 0.83 MPa, and 0.9 MPa, respectively.

Here, the pressure regulation valve 29 is not limited to an on-off valve such as an electrically-activated motor valve as described in Patent Literature 1, and may be a pressure regulation valve that mechanically opens and closes, instead of being electrically-activated. Further, the on-off valve is preferably an on-off valve that is electrically-activated by the pressure detector, but may be a pressure regulation valve that mechanically opens and closes in response to the pressure.

An auxiliary feed line 30 configured to supply the makeup water in the makeup water tank 7 to the steam boiler 2 when the drain pump 14 stops and the drain may not be supplied to the steam boiler 2 is provided between the makeup water tank 7 and the steam boiler 2. The auxiliary feed line 30 includes an auxiliary pump 31 attached to the steam boiler 2, and a third check valve 32 configured to block the flow toward the auxiliary pump 31.

Further, the makeup water tank 7 includes a first condensing unit 33. The first condensing unit 33 is a device having a function of condensing the first flush steam by bringing the first flush steam introduced into the makeup water tank 7 through the pressure relief line 10 and the relatively low temperature makeup water circulated within the makeup water tank 7 into contact with each other.

Figure 2:
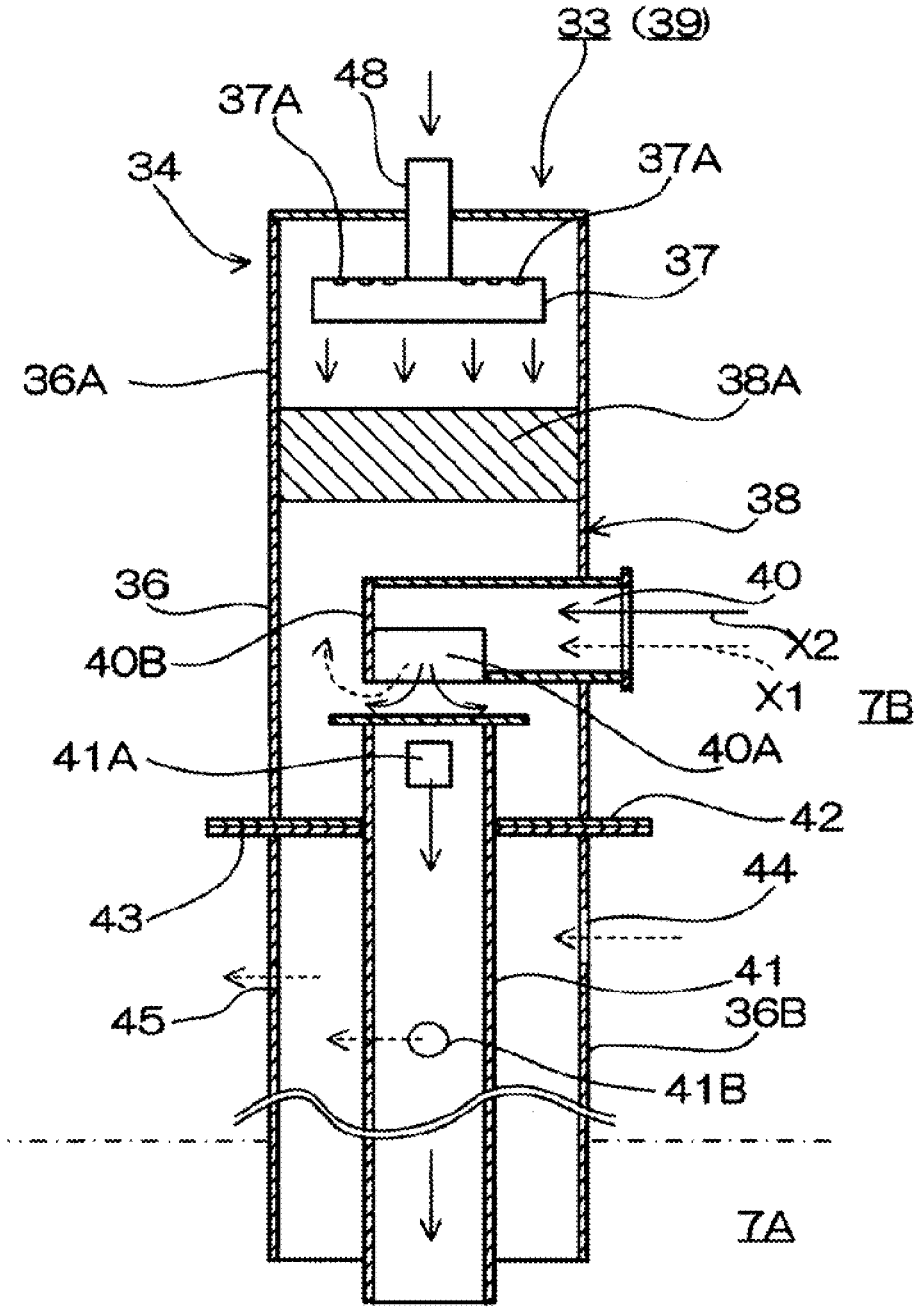
FIG. 2 is a general configuration diagram illustrating a section of a condensing unit of the first embodiment.

The first condensing unit 33 specifically has the configuration illustrated in FIG. 1 and FIG. 2. The first condensing unit 33 includes a mixer means 34 and a circulation means 35. The mixer means 34 is provided with an upper main body 36A of a tube-like main body 36 in a two-part structure as a mixer 38 in which the first flush steam is brought into contact with the makeup water sprinkled from a sprinkler 37 to be condensed. The mixer 38 is provided with, in an order from its top, the sprinkler 37, a contact heat exchange member 38A configured by a demister, a connecting unit 40 connected to the pressure relief line 10, and a tube-like water introduction unit 41 for introducing the condensed water generated by the mixer 38 to the liquid phase unit 7A in the makeup water tank 7.

The sprinkler 37 is provided with a large number of spray holes 37A for spraying the makeup water upward like shower. It should be appreciated that the structure of sprinkling including the direction of the sprinkler 37 for spraying the makeup water is not limited to the illustrated example. The contact heat exchange member 38A is provided so as to partition the mixer 38 into an upper space and a lower space.

The connecting unit 40 is configured in a tube shape whose tip end is closed, and has an inlet 40A on a side of a lower surface. The tip end of the connecting unit 40 serves as a separating plate 40B against which the drain hits when two-phase flow drain is introduced to separate the drain from the steam. Further, the water introduction unit 41 closes an upper end, and a plurality of water inlets 41A are provided around a circumferential surface so that the steam and the drain may not immediately enter the water introduction unit 41. The connecting unit 40 constitutes a steam separator according to the present invention. It should be appreciated that the steam separator is not necessarily required as the first flush steam, instead of the drain, is introduced to the first condensing unit 33.

Further, a lower end of the water inlet 41A is configured higher than an upper surface of a later-described partitioning plate 42 that constitutes an inner bottom surface of the mixer 38 so that the condensed water is reserved at an inner bottom portion of the mixer 38. In addition, in order to prevent oxygen from re-dissolving within the mixer 38, a temperature of the reserved condensed water is detected by a sensor (not depicted), and an amount of circulating makeup water is adjusted by flow rate adjustment means (not depicted) provided for a circulation line 48 so that the detected temperature is maintained at 95° C. to 100° C. The flow rate adjustment means may be manual adjustment, but may be automatic adjustment by the controller 12.

The water introduction unit 41 is held by the partitioning plate 42 and a partitioning plate 43 that partitions the tube-like main body 36 into the upper main body 36A and a lower main body 36B at a joined portion therebetween. The lower main body 36B includes a steam inlet hole 44 to which a branch of the pressure relief line 10 is connected, and a first steam outlet hole 45 that communicates to a gaseous phase unit 7B of the makeup water tank 7, and a second steam outlet hole 41B is provided in a circumferential surface of the water introduction unit 41. The first steam outlet hole 45 and the second steam outlet hole 41B are for preventing re-dissolving of oxygen by introducing steam present within the water introduction unit 41 to the gaseous phase unit 7B of the makeup water tank 7 so as to make a slight amount of steam present within the gaseous phase unit 7B.

The steam inlet hole 44 is for purging the air within the makeup water tank 7 by taking out steam from a branch line (not depicted) branched in the middle of the drain return line 3, and introducing the taken out steam into the lower main body 36B and then to the gaseous phase unit 7B of the makeup water tank 7 through the first steam outlet hole 45. The steam introduced into the lower main body 36B may be a part of the steam generated in the steam boiler 2 directly taken out from the steam boiler 2. The second steam outlet hole 41B is for introducing the steam included in liquid passing through the water introduction unit 41 to the gaseous phase unit 7B.

Referring to FIG. 1, the circulation means 35 includes a circulation pump 47, and a makeup water circulation line 48 for introducing the makeup water in the lower portion of the makeup water tank 7 to the sprinkler 37. In addition, the makeup water tank 7 includes a second temperature sensor 50 as a second temperature detector configured to detect the temperature of the makeup water in the makeup water tank 7.

Further, the makeup water tank 7 includes a second condensing unit 39 having the same configuration as the first condensing unit 33. The second condensing unit 39 is a device having a function of condensing the second flush steam by bringing the second flush steam generated by the surplus drain introduced into the makeup water tank 7 through the drain relief line 8 and the relatively low temperature makeup water circulated within the makeup water tank 7 into contact with each other. As the structure of the second condensing unit 39 is the same as that of the first condensing unit 33 illustrated in FIG. 2, description for this component shall be omitted.

The controller 12 controls the first valve V1 to the fifth valve V5, the drain pump 14, the makeup water pump 22, and the like based on control procedures previously recorded by inputting signals from the pressure sensor 18, the water level sensor 19, the float switch 20, the pressure switch 21, the first temperature sensor 28, the second temperature sensor 50, and the like. Here, the auxiliary pump 31 is controlled by a controller on a side of the steam boiler 2, but may be controlled by the controller 12.

The control procedures of the controller 12 include a procedure for controlling the pressure in the drain tank, a procedure for controlling the water level and the temperature of the drain, a drain circulation control procedure for controlling the circulation in the drain circulation line 11, a procedure for controlling the temperature of the makeup water, and the like.

The procedure for controlling the pressure in the drain tank is a procedure of opening the fourth valve V4 when the pressure sensor 18 detects the second operating pressure PH higher than the operating pressure (first operating pressure) of the pressure regulation valve 29, and closing the fourth valve V4, closing the pressurized steam line 9, closing the first valve V1, and opening the second valve V2 when the pressure switch 21 detects the third operating pressure PHH higher than the second operating pressure PH. Here, the first operating pressure is set to be higher than a second setting pressure PL. This control procedure is realized by control procedures shown in FIG. 3, FIG. 4, and FIG. 8.

The procedure for controlling the water level and the temperature of the drain includes a first control and a second control described below. The first control is for driving the makeup water pump 22 when the temperature detected by the first temperature sensor 28 exceeds a first setting temperature TH, stopping the makeup water pump 22 when the detected temperature is equal to or lower than the first setting temperature TH; while the makeup water pump 22 drives, stopping the makeup water pump 22 and bringing the first valve V1 and the second valve V2 into a second open-close state when the water level detected by the water level sensor 19 exceeds a first setting water level LHH; and driving the makeup water pump 22 and bringing the first valve V1 and the second valve V2 into a first open-close state when the water level is equal to or lower than the first setting water level LHH.

The second control is for, while the makeup water pump 22 drives, bringing the first valve V1 and the second valve V2 into the second open-close state when the temperature detected by the first temperature sensor 28 exceeds a second setting temperature THH that is higher than the first setting temperature TH, and bringing the first valve V1 and the second valve V2 into the first open-close state when the detected temperature is lower than the second setting temperature THH. The first control and the second control are realized by control procedures shown in FIG. 3, FIG. 4, and FIG. 6.

In the first embodiment, the first setting temperature TH and the second setting temperature THH are respectively 170° C. and 175° C. However, the temperature may be set appropriately within a range from 100° C. to 220° C. depending on the configuration and operating conditions of the system.

Figure 9:
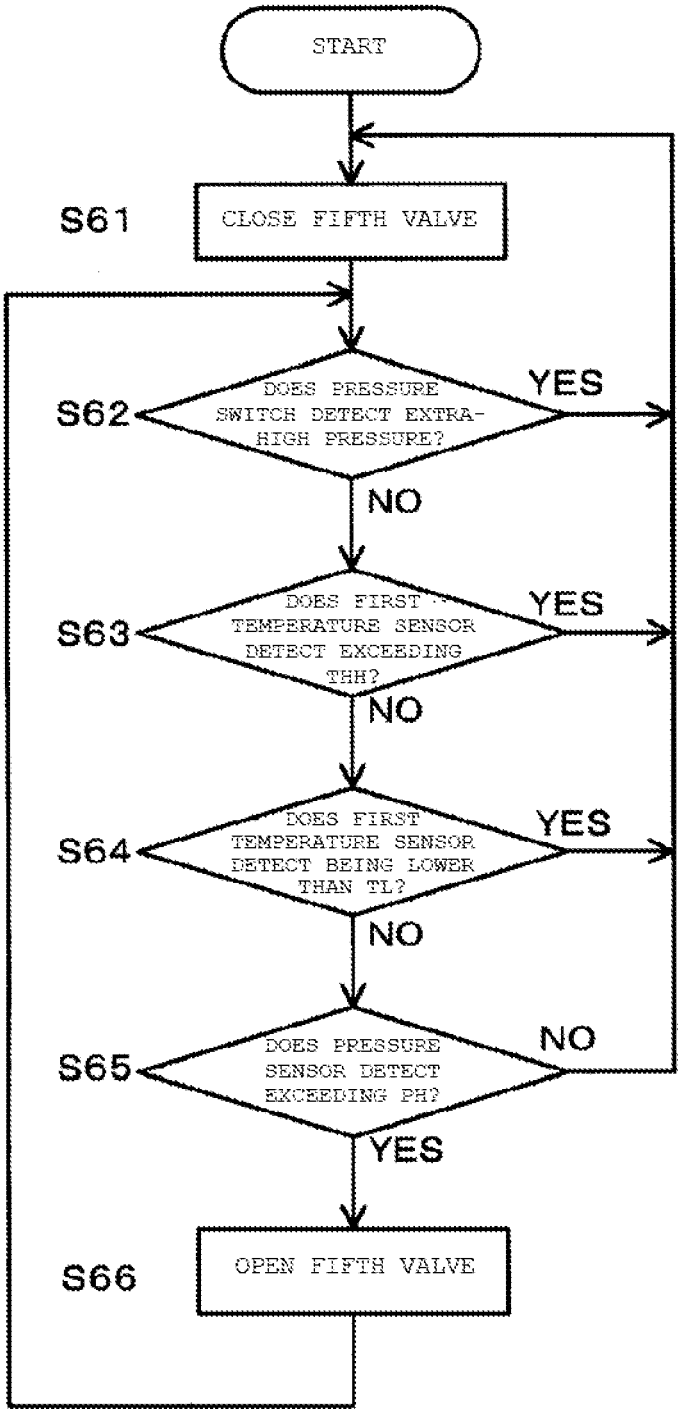
FIG. 9 is a flowchart explaining a control program for a fifth valve of the first embodiment.

The drain circulation control procedure includes: a procedure of stopping circulation of the drain through the first circulation line 11A when the temperature detected by the first temperature sensor 28 exceeds (or equal to) the first setting temperature TH, or lower than (or equal to) a third setting temperature TL that is lower than the first setting temperature TH; and a procedure of performing circulation of the drain through the first circulation line 11A when the pressure detected by the first pressure detector 18 exceeds (or equal to) a first setting pressure PH. An example of the drain circulation control procedure is shown in FIG. 9.

(Procedure for Controlling Temperature of Makeup Water)

Figure 10:
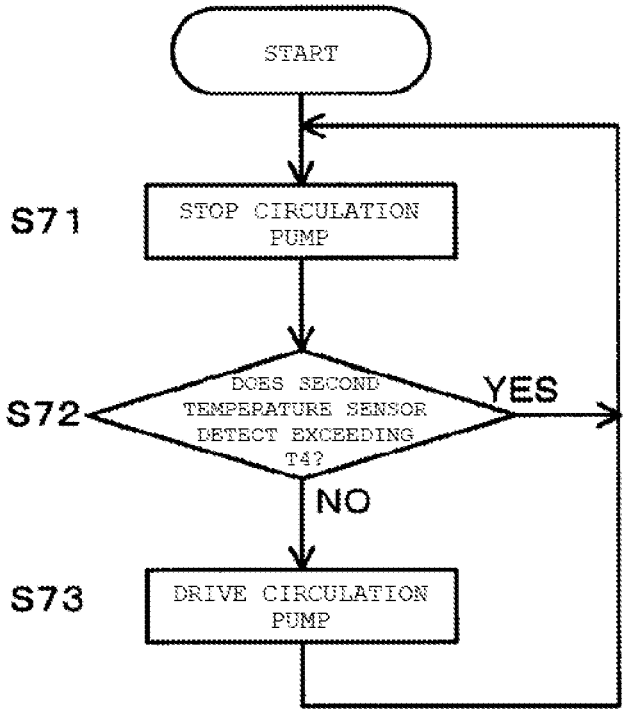
FIG. 10 is a flowchart explaining a control program for a circulation pump of the first embodiment.

The procedure for controlling the temperature of the makeup water is a control procedure of stopping the circulation pump 47 when the temperature detected by the second temperature sensor 50 exceeds a fourth setting temperature T4; and of driving the circulation pump 47 when the detected temperature is equal to or lower than the temperature that is lower than the fourth setting temperature T4 by differential. The procedure for controlling the temperature of the makeup water equalizes the temperature within the makeup water tank 7 by driving the circulation pump 47, promotes recovery of a greater amount of flush steam, and prevents occurrence of vibration and such due to the temperature within the makeup water tank 7 exceeding the fourth setting temperature T4. An example of the procedure for controlling the temperature of the makeup water is shown in FIG. 10.

Further, specific control procedures of the first valve V1, a control procedure of the second valve V2, a control procedure of the makeup water pump 22, a control procedure of the drain pump 14, a control procedure of the third valve V3, a control procedure of the fourth valve V4, a control procedure of the fifth valve V5, and a control procedure of the circulation pump 47 of the first embodiment are respectively shown in FIG. 3, FIG. 4, FIG. 5, FIG. 6, FIG. 7, FIG. 8, FIG. 9, and FIG. 10.

<Basic Operation in First Embodiment>

(Procedure for Controlling Water Level and Temperature of Drain)

Here, an operation by the procedure for controlling the water level and the temperature of the drain of the first embodiment will be described with reference to FIG. 1 to FIG. 6. Referring to FIG. 1, steam supplied from the boiler 2 is liquefied in the loading apparatus 13. The liquefied drain attempts to flow to the drain tank 4 through the drain return line 3.

Figure 3:
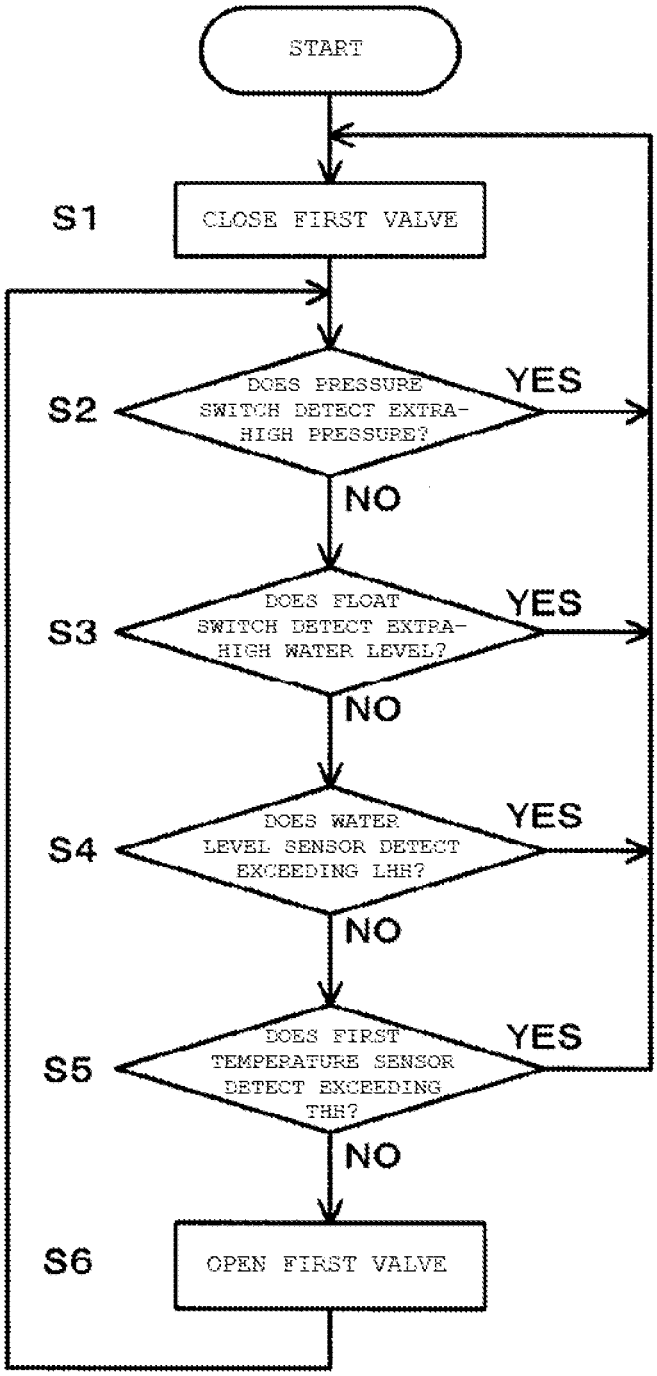
FIG. 3 is a flowchart explaining a control program for a first valve of the first embodiment.
Figure 4:
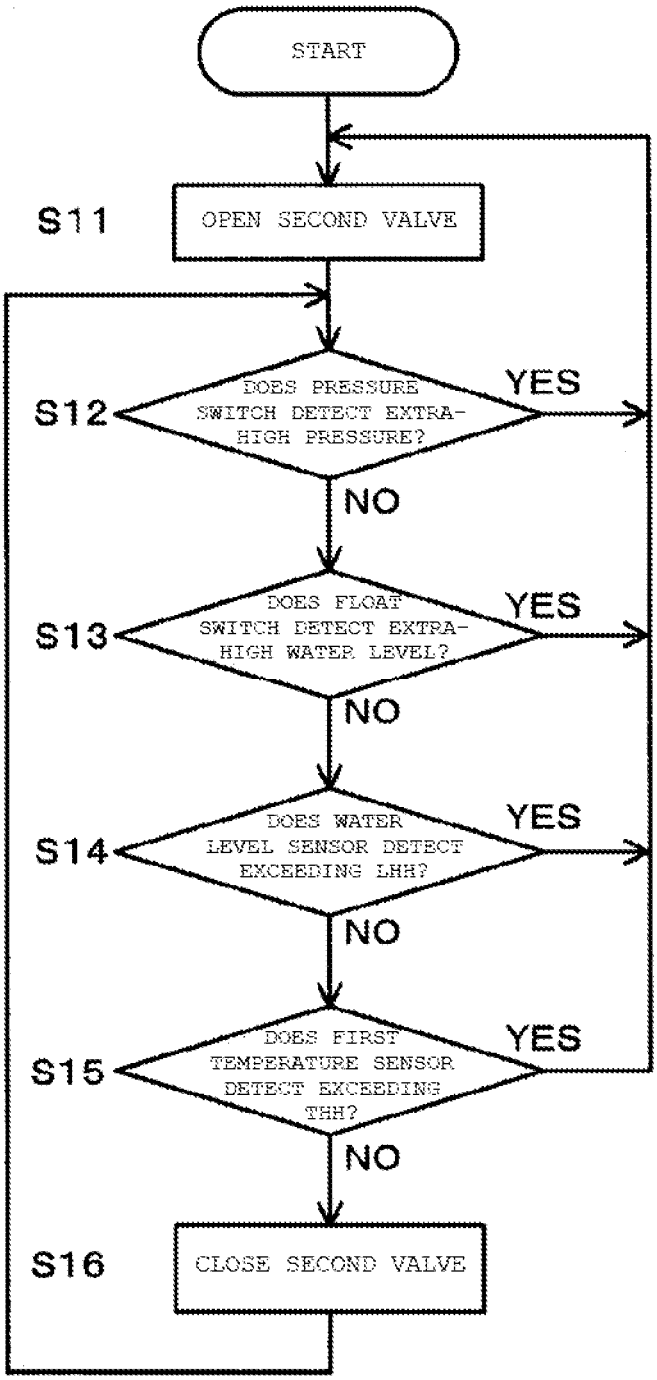
FIG. 4 is a flowchart explaining a control program for a second valve of the first embodiment.

Referring to FIG. 3 and FIG. 4, when an operation switch (not depicted) of the system is turned ON, in Processing Step S1 (hereinafter, Processing Step SN is simply referred to as SN) and S11, the first valve V1 is closed and the second valve V2 is opened (second open-close state), the process moves to S2 and S12, and whether or not the pressure switch 21 is turned ON is determined. When a pressure in the water gauge 15 becomes equal to or higher than an extra-high pressure setting pressure (a setting pressure higher than the first setting pressure PH as will be described later), the pressure switch 21 is turned ON. Therefore, it is determined to be YES in S2 and S12, the process returns to S1 and S11, and the second open-close state is maintained.

In this manner, when the pressure within the drain tank 4 is an extra-high pressure, the drain from loading apparatus 13 is prevented from flowing into the drain tank 4, and flows to the makeup water tank 7, instead. As a result, even when the pressure within the drain tank 4 is an extra-high pressure, the drain is recovered in the makeup water tank 7 while the operation of the loading apparatus 13 is continued. The recovery of the drain is performed by the second condensing unit 39 as described above. The second condensing unit 39 performs recovery of the second flush steam generated when the drain flows into the makeup water tank 7, and its detailed operation will be described later.

Figure 6:
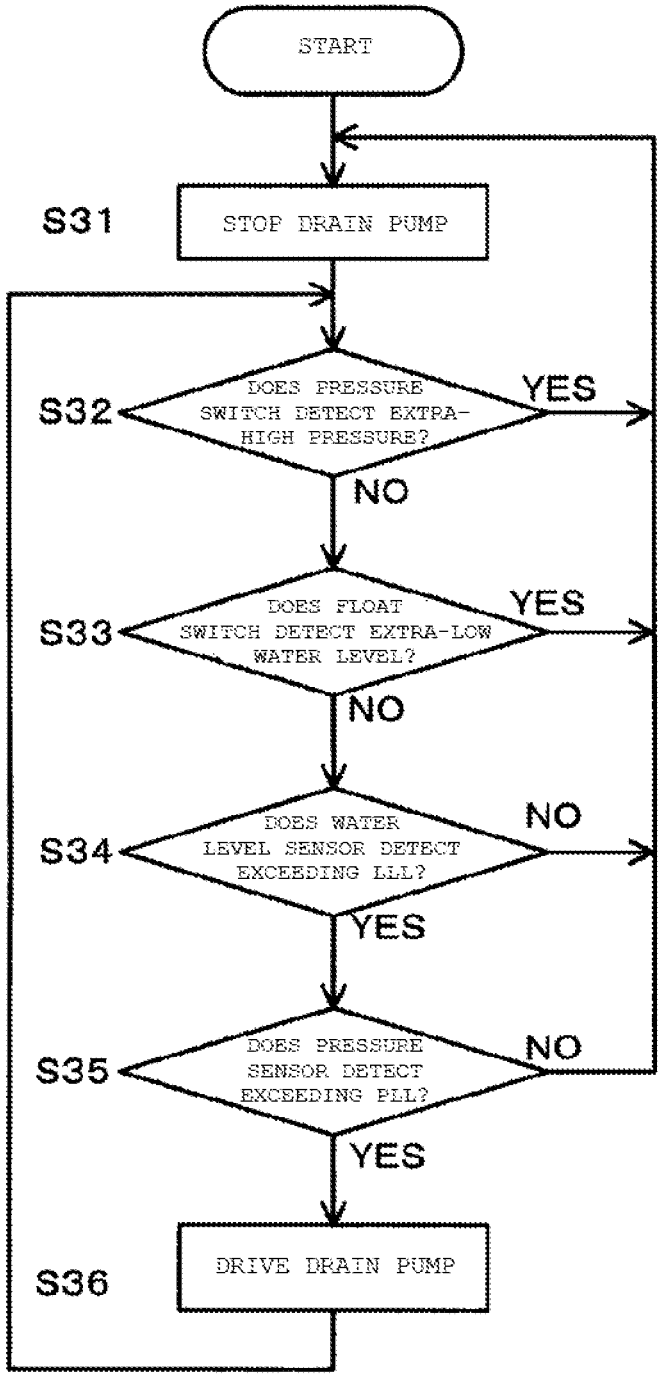
FIG. 6 is a flowchart explaining a control program for a drain pump of the first embodiment.
Figure 7:
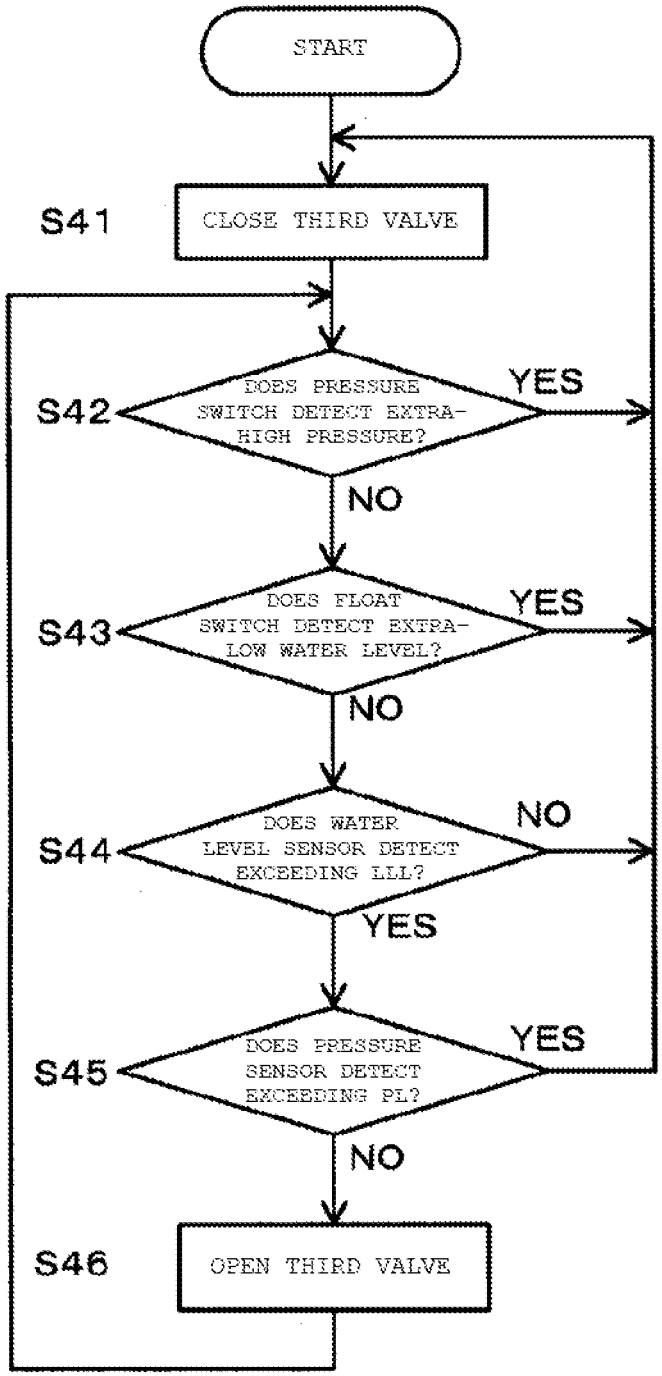
FIG. 7 is a flowchart explaining a control program for a third valve of the first embodiment.

At this time, as it is also determined to be YES in S32 of FIG. 6, the drain pump 14 is stopped, and water supply from the drain tank 4 to the steam boiler 2 is stopped. However, the controller (not depicted) of the steam boiler 2 drives the auxiliary pump 31, if it is determined that there is no water supply from the drain tank 4. As a result, water is kept supplied from the makeup water tank 7 to the steam boiler 2, and therefore the operation of the steam boiler 2 continues, and it is possible to continuously use the steam in the loading apparatus 13.

Referring back to FIG. 3 and FIG. 4, when it is determined to be NO in S2 and S12, the process moves to S3 and S13, it is determined whether or not the float switch 20 detects the water level equal to or higher than the extra-high setting water level (a setting water level higher than the first setting water level LHH that will be described later). When the water level in the water gauge 15 becomes equal to or higher than the extra-high setting water level, it is determined to be YES in S3 and S13, the process returns to S1 and S11, and the second open-close state is maintained. It should be appreciated that when the water level sensor 19 operates normally, the float switch 20 may not be activated, and it may not be determined to be YES in S3 and S13.

In this manner, similarly to the case in which the pressure within the drain tank 4 is the extra-high pressure, the drain is recovered to the makeup water tank 7 while driving of the loading apparatus 13 is continued when the water level in the drain tank 4 is the extra-high water level. At this time, while the drain pump 14 is stopped, driving of the steam boiler 2 continues by driving the auxiliary pump 31, similarly to the case in which the water level in the drain tank 4 is at the extra-high water level.

When it is determined to be NO in S3 and S13, the process moves to S4 and S14, and it is determined whether or not the water level sensor 19 detects a value exceeding the first setting water level LHH (a value higher than LHH by differential). When the water level of the water gauge 15 exceeds the first setting water level LHH, it is determined to be YES in S4 and S14, the process returns to S1 and S11, and the second open-close state is maintained.

In this manner, when the water level in the drain tank 4 exceeds the first setting water level LHH, the drain is prevented from flowing into the drain tank 4, and the water level within the drain tank 4 is prevented from being the extra-high water level. Then, similarly to the case in which the pressure within the drain tank 4 is the extra-high pressure, the drain is recovered to the makeup water tank 7 while driving of the loading apparatus 13 is continued. At this time, while the drain pump 14 is stopped, driving of the steam boiler 2 continues by driving the auxiliary pump 31, similarly to the case in which the water level in the drain tank 4 is at the extra-high water level.

Then, when it is detected that the water level detected by the water level sensor 19 is equal to or lower than the first setting water level LHH, it is determined to be NO in S4 and S14, the process moves to S5 and S15, and it is determined whether or not the temperature detected by the temperature sensor 28 exceeds the second setting temperature THH (a value higher than THH by differential is detected). When it is determined to be YES in S5 and S15, the process moves to S1 and S11, and the second open-close state is maintained. Then, when it is detected that the temperature detected by the temperature sensor 28 is equal to or lower than the second setting temperature THH, it is determined to be NO in S5 and S15, the process moves to S6 and S16, the first valve V1 is opened and the second valve V2 is closed (first open-close state), and the drain from the loading apparatus 13 flows into the drain tank 4.

In this manner, based on the processing in S5 and S15, by preventing high-temperature drain from flowing into the drain tank 4 when the temperature detected by the temperature sensor 28 exceeds the second setting temperature THH, the temperature of the drain in the drain tank 4 is prevented from exceeding the second setting temperature THH. The operation of preventing the drain from flowing into the drain tank 4 and an operation for cooling the drain controlled by the makeup water pump 22 that will be described next, it is possible to achieve quick decrease of the temperature of the drain in the drain tank 4.

Figure 5:
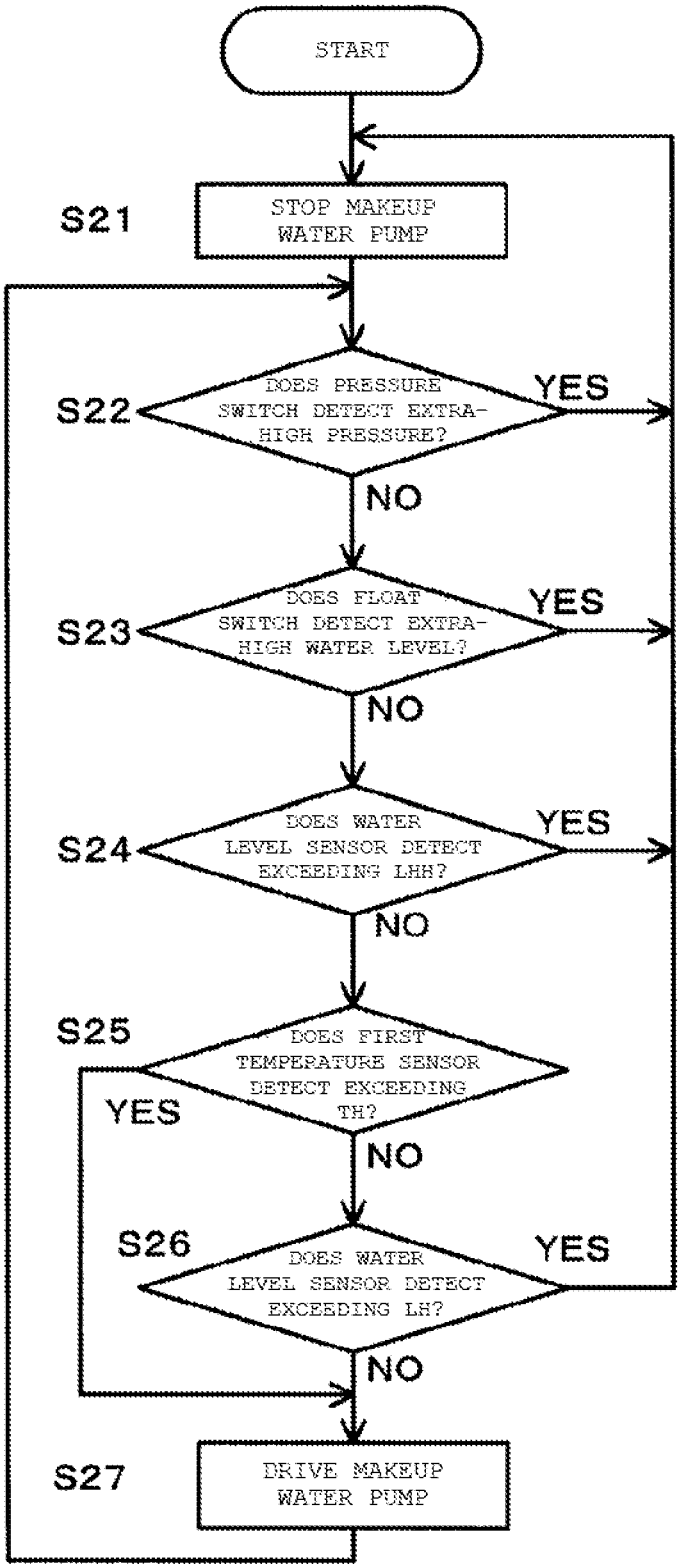
FIG. 5 is a flowchart explaining a control program for a makeup water pump of the first embodiment.

Next, an operation of the makeup water pump 22 will be described with reference to FIG. 5. In S21, the makeup water pump 22 is stopped. Then, in S22, it is determined whether or not the pressure switch 21 is ON. When YES, the process moves to S21, the makeup water pump 22 is stopped. When NO, the process moves to S23, and it is determined whether or not the float switch 20 detects the extra-high setting water level.

When it is determined to be YES in S23, the makeup water pump 22 is stopped. When it is determined to be NO in S23, the process moves to S24, and it is determined whether or not the water level sensor 19 detects a value exceeding the first setting water level LHH (>LH) (a value higher than LHH by differential is detected). When YES, the process moves to S21, and the makeup water pump 22 is stopped.

As will be described later, when the water level in the drain tank 4 decreases and the detected water level is equal to or lower than the first setting water level LHH by driving the drain pump 14, it is determined to be NO in S24, the process moves to S25, and it is determined whether or not the temperature detected by the first temperature sensor 28 exceeds the first setting temperature TH (<THH) (a value higher than TH by differential is detected). When the detected temperature exceeds the first setting temperature TH, and it is determined to be YES in S25, the process moves to S27, and the makeup water pump 22 is driven. By driving of the makeup water pump 22, the low temperature makeup water is supplied from the makeup water tank 7 to the drain tank 4.

When the temperature detected by the first temperature sensor 28 is equal to or lower than the first setting temperature TH, and it is determined to be NO in S25, the process moves to S26, and it is determined whether or not the water level in the drain tank 4 exceeds the second setting water level LH (a value higher than LH by differential is detected). When it is determined to be YES, the process moves to S21, the makeup water pump 22 is stopped. As will be described later, by driving the drain pump 14, when the water level in the drain tank 4 decreases, the water level becomes equal to or lower than the second setting water level LH, and it is determined to be NO in S26, the process moves to S27, and the makeup water pump 22 is driven. By driving of the makeup water pump 22, the low temperature makeup water is supplied from the makeup water tank 7 to the drain tank 4.

In this manner, when the temperature of the drain in the drain tank 4 exceeds the first setting temperature TH, and the water level in the drain tank 4 is equal to or lower than the first setting water level LHH, the makeup water pump 22 is driven, and the control to cool the drain in the drain tank 4 (first control) is performed. Then, as described above, when the water level in the drain tank 4 exceeds the first setting water level LHH, or the temperature of the drain is equal to or higher than the second setting temperature THH, the control for preventing a large amount of heat contained in the drain from being taken into the drain tank 4 (second control) is performed by bringing the first valve V1 and the second valve V2 into the second open-close state. As a result, even when the temperature in the drain tank 4 becomes equal to or higher than the second setting temperature THH, the drain in the drain tank 4 is cooled by the first control and the second control in a shorter period of time than in the system described in Patent Literature 1. With this, it is possible to reduce operating time of the makeup water pump 22, and to save electricity.

Next, an operation of the drain pump 14 will be described with reference to FIG. 6. In S31, the drain pump 14 is stopped. Then, the process moves to S32, and it is determined whether or not the pressure switch 21 is ON. When YES, the process moves to S31, and the drain pump 14 is stopped.

When it is determined to be NO in S32, the process moves to S33, and the float switch 20 determines whether or not the water level is equal to or higher than an extra-low setting water level. When YES, the process moves to S31, and the drain pump 14 is stopped. When it is determined to be NO in S33, the process moves to S34, and it is determined whether or not the sensor 19 detects a value exceeding a third setting water level LLL (<second setting water level LH) (a value higher than LLL by differential). When it is determined to be NO, the process moves to S31, the drain pump 14 is stopped, and water supply to the steam boiler 2 is not performed.

When the water level in the drain tank 4 exceeds the third setting water level LLL, it is determined to be YES in S34, the process moves to S35, and the pressure sensor 18 determines whether or not the pressure exceeds a third setting pressure PLL that is lower than the second setting pressure PL (a value higher than PLL by differential). When, in S35, the pressure equal to or lower than the third setting pressure PLL is detected, it is determined to be NO, the process moves to S31, and the drain pump 14 is stopped. When, it is determined to be YES in S35, the process moves to S36, and the drain pump 14 is driven.

In this manner, the drain pump 14 is driven to supply the drain from the drain tank 4 to the steam boiler 2 basically on a condition that the water level in the drain tank 4 exceeds the third setting water level LLL, and that the pressure exceeds the third setting pressure PLL. It should be appreciated that when the drain pump 14 is stopped by failure, as described previously, the steam boiler 2 continues to be driven by driving the auxiliary pump 31.

(Control of Pressure in Drain Tank)

Next, control of the pressure in the drain tank 4 will be described. First, an operation of the third valve V3 will be described with reference to FIG. 7. In S41, the third valve V3 is closed. Then, the process moves to S42, it is determined whether or not the pressure switch 21 (turned ON when the pressure exceeds the third operating pressure PHH, and turned OFF when the pressure is decreased by an amount of differential) is ON. When YES, the process moves to S41, the third valve V3 is closed, and the drain tank 4 is controlled so that the extra-high setting pressure may not be exceeded.

When it is determined to be NO in S42, the process moves to S43, and the float switch 20 determines whether or not the water level is equal to or lower than the extra-low setting water level. When YES, the process moves to S41, and the third valve V3 is closed. When it is determined to be NO in S43, the process moves to S44, and it is determined whether or not the water level sensor 19 detects a value exceeding the third setting water level LLL (a value higher than LLL by differential). When it is determined that the water level is equal to or lower than the third setting water level LLL and NO, the third valve V3 is closed.

When it is determined to be YES in S44, the process moves to S45, and the pressure sensor 18 determines whether or not the pressure exceeds the second setting pressure PL that is lower than the extra-high setting pressure and higher than the third setting pressure PLL (a value higher than PL by differential). When YES, the process moves to S41, and the third valve V3 is closed. When the detected pressure is equal to or lower than the second setting pressure PL in S45, it is determined to be NO, the process moves to S46, and the third valve V3 is opened.

In this manner, the third valve V3 opens basically on a condition that the water level in the drain tank 4 is equal to or higher than the third setting water level LL and the pressure is lower than the second setting pressure PL, so as to supply the steam to the drain tank 4 through the pressurized steam line 9 and maintains the pressure in the drain tank 4 substantially at the second setting pressure PL.

Figure 8:
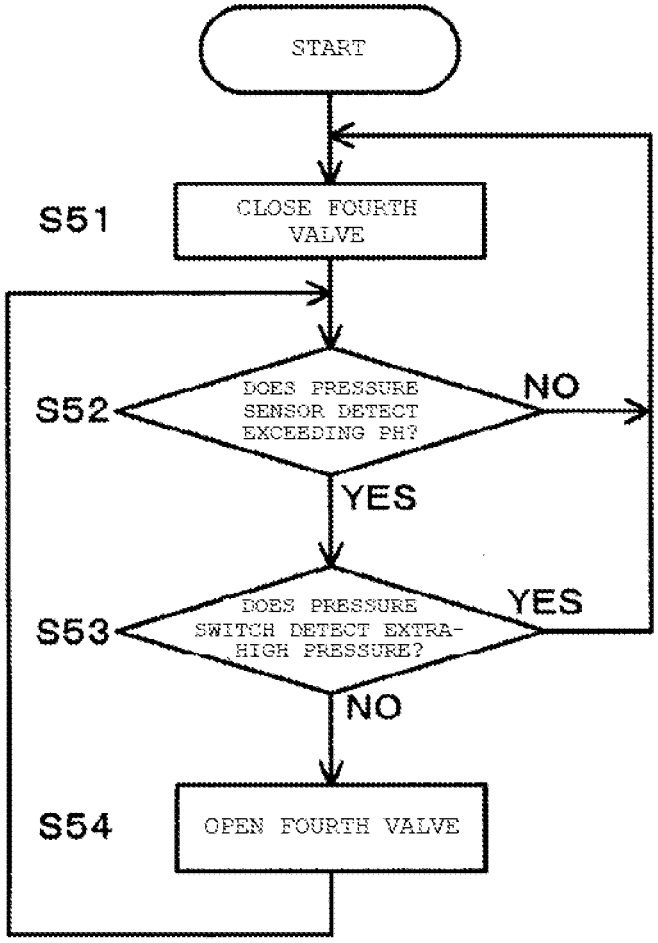
FIG. 8 is a flowchart explaining a control program for a fourth valve of the first embodiment.

Next, an operation of the fourth valve V4 will be described with reference to FIG. 8. In S51, the fourth valve V4 is closed. Referring to FIG. 1, as the pressure regulation valve 29 opens when the pressure in the drain tank 4 is equal to or higher than the setting pressure (a value lower than the extra-high setting pressure and higher than the second setting pressure PL), the pressure in the drain tank 4 is controlled to be lower than the setting pressure of the pressure regulation valve 29. However, when, due to reasons such as a failure of the pressure regulation valve 29, the pressure increases, and the pressure detected by the pressure sensor 18 exceeds the first setting pressure PH (a value lower than the extra-high setting pressure and higher than the second setting pressure PL) (a value higher than PH by differential), it is determined to be YES in S52 and NO in S53, and the fourth valve V4 is opened in S54.

When the pressure further increases due to reasons such as a failure of the fourth valve V4, and the pressure switch 21 detects the extra-high pressure, the pressure switch 21 is turned ON, it is determined to be YES in S53, and the fourth valve V4 is closed. When the pressure switch 21 detects the extra-high pressure, an operation of stopping the system 1 in an interlock state is performed. Closing of the fourth valve V4 is a part of the interlocking operation. Here, it is possible to configure such that if the state is not the interlock state, the fourth valve V4 is opened when it is determined to be YES in S53.

When a value equal to or lower than the first setting pressure PH is detected in S52, it is determined to be NO, the process moves to S51, and the fourth valve V4 is closed.

In this manner, as the fourth valve V4 opens basically on a condition that the pressure in the drain tank 4 exceeds the first setting pressure PH, even if the pressure regulation valve 29 goes out of order, high-pressure steam in the drain tank 4 may be released through the steam relief line 10 to the makeup water tank 7 via the first condensing unit 33 to prevent the pressure in the drain tank 4 from becoming extra high. The high-pressure steam in the drain tank 4 includes flush steam generated when the drain flows into the drain tank 4 and pressurized steam introduced to the drain tank 4 through the pressurized steam line 9, and both of these are referred to as the first flush steam in the present invention. The first condensing unit 33 performs recovery of the first flush steam, and its detailed operation will be described later.

(Control of Heat Recovery from Flush Steam)

Next, the control of heat recovery from the first flush steam in the drain tank 4 will be described. First, an operation of the fifth valve V5 will be described with reference to FIG. 9. In S61, the fifth valve V5 is closed. Assuming that the drain pump 14 is currently driven, the drain in the drain tank 4 circulates through the second circulation line 11B, the minimum flow in the drain pump 14 is ensured, and the temperature of the drain in the drain tank 4 is equalized.

Then, in S62, it is determined whether or not the pressure switch 21 is turned ON. When YES, the process moves to S61, the fifth valve V5 is closed, and the drain may not be sprayed into the drain tank 4 through the first circulation line 11A.

When it is determined to be NO, the process moves to S63, and it is determined whether or not the temperature detected by the temperature sensor 28 exceeds the second setting temperature THH. When it is determined to be YES in S63, the process moves to S61, the fifth valve V5 is closed, and the drain may not be sprayed into the drain tank 4.

When it is determined to be NO in S63, the process moves to S64, and it is determined whether or not the temperature detected by the temperature sensor 28 is lower than the third setting temperature TL. When it is determined to be YES in S64, the process moves to S61, the fifth valve V5 is closed, and the drain may not be sprayed into the drain tank 4. The reason of this is as follows: in order to prevent the pressure in the drain tank 4 from decreasing by spraying the drain when the temperature of the drain in the drain tank 4 is low, the third valve V3 from being opened, and the steam from being supplied through the pressurized steam line 9.

When a value exceeding the third setting temperature TL (a value higher than TL by differential) is detected, it is determined to be NO in S64, the process moves to S65, and it is determined whether or not the pressure within the drain tank 4 exceeds the first setting pressure PH (a value higher than PH by differential). When the pressure equal to or lower than the first setting pressure PH is detected, it is determined to be NO in S65, the fifth valve V5 is closed in S61, and the drain may not be sprayed into the drain tank 4. The reason of this is as follows: in order to prevent the pressure in the drain tank 4 from further decreasing by spraying the drain when the pressure within the drain in the drain tank 4 is low, the third valve V3 from being opened, and the steam from being supplied through the pressurized steam line 9.

When a value exceeding the first setting pressure PH is detected in S65, it is determined to be YES, the process moves to S66, and the fifth valve V5 is opened. Then, the drain in the drain tank 4 is sprayed to the gaseous phase unit in the drain tank 4 from the spray pipe 26 through the first circulation line 11A, and the heat of the gaseous phase unit in the drain tank 4 is efficiently recovered by the spraying to obtain high-temperature drain. During spraying of the drain through the first circulation line 11A, the drain is circulated through the second circulation line 11B.

In this manner, the fifth valve V5 opens to spray the drain from the spray pipe 26 basically on a condition that the temperature of the drain in the drain tank 4 is equal to or lower than the second setting temperature THH and equal to or higher than the third setting temperature TL, and the pressure within the drain tank 4 exceeds the first setting pressure PH. As a result, it is not necessary to increase the temperature of the drain more than necessary, and it is possible to efficiently recover the heat of the gaseous phase unit in the drain tank 4 to obtain high-temperature drain.

<Operation of First Condensing Unit>

Next, an operation of the first condensing unit 33 will be described. When the high-temperature and high-pressure (e. g., 1.2 MPa) drain flows into the drain tank 4 through the drain return line 3, and is brought into contact with the steam and the drain in the drain tank 4 whose temperature and pressure are lower than those of the drain flowing into (e. g., 0.8 MPa), the first flush steam is generated. The first flush steam flows into the makeup water tank 7 through the pressure relief line 10 and the first condensing unit 33 as described previously.

Here, the control of the circulation pump 47 will be described. Referring to FIG. 10, the circulation pump 47 is stopped in S71. In S72, it is determined whether or not a value of the temperature detected by the second temperature sensor 50 exceeds T4 (a value higher than T4 by differential) . When it is determined to be YES, the circulation pump 47 continues to be stopped. When it is detected that the value is equal to or lower than T4 in S72, the process moves to S73, and the circulation pump 47 is driven. It should be noted that the control of the circulation pump 47 of the second condensing unit 39 is the same as that of the circulation pump 47 in the first condensing unit 33.

By driving the circulation pump 47, as illustrated in FIG. 2, relatively low temperature makeup water at the bottom within the makeup water tank 7 is introduced to the sprinkler 37 through the makeup water circulation line 48, and sprayed like shower from the spray holes 37A. As shown by a solid arrow in FIG. 2, the sprayed makeup water falls down toward the contact heat exchange member 38A.

On the other hand, as shown by a dashed arrow X1 in FIG. 2, the first flush steam through the pressure relief line 10 hits against the separating plate 40B of the connecting unit 40, changes its direction, flows into the mixer 38 through the inlet 40A, and fills the mixer 38 under the contact heat exchange member 38A. If the first flush steam contains liquid droplets, the droplets are separated when hitting against the separating plate 40B, and reserved at the inner bottom portion in the mixer 38.

In the contact heat exchange member 38A, liquid molecules contained in the makeup water from the sprinkler 37 are collected, and the falling velocity decreases. The first flush steam is efficiently condensed by being brought into contact and mixed with the makeup water in the contact heat exchange member 38A. Here, when the collected liquid molecules and the first flush steam are brought into contact with each other, the flush steam is newly generated at the same time as condensing. However, the flush steam generated here is also cooled and condensed in the contact heat exchange member 38A. The condensed water flows into the water introduction unit 41 through the water inlet 41A after reserved at the inner bottom portion in the mixer 38, and is introduced to the liquid phase unit 7A of the makeup water tank 7.

<Operation of Second Condensing Unit>

Next, an operation of the second condensing unit 39 will be described. The operation of the second condensing unit 39 is basically the same as that of the first condensing unit 33. However, there is a difference that while the fluid that flows into is the steam in the case of the first condensing unit 33, it is the high-temperature and high-pressure drain that flows into through the drain relief line 8 in the case of the second condensing unit 39. In the following, the description is given focusing on a difference in the operation due to the difference in the fluid.

By driving the circulation pump 47, as illustrated in FIG. 2, the makeup water sprayed from the sprinkler 37 falls down toward the contact heat exchange member 38A as shown by the solid arrow in FIG. 2. The drain through the drain relief line 8 is a two-phase flow of liquid and steam. As shown by a solid arrow X2 in FIG. 2, the drain flows from the connecting unit 40 based on a pressure difference, and hits against the separating plate 40B. The liquid and the gas are separated here. The separated steam changes its direction, flows into the mixer 38 through the inlet 40A, and moves upward toward the contact heat exchange member 38A. Then, the drain that flows into and the liquid or the steam in the mixer 38 are brought into contact with each other to generate the second flush steam. The separated drain falls downward and is reserved at the inner bottom portion in the mixer 38. The separated steam and the second flush steam are condensed by the contact heat exchange member 38A similarly to the case of the first condensing unit 33. By the separation of the steam by the separating plate 40B, it is possible to improve a contact efficiency between the flush steam and the makeup water.

(Effects of First Embodiment)

Now, effects of the first embodiment will be described. Assuming that the effective drain recovery rate is the same, the drain recovery system according to the first embodiment can downsize the drain tank 4 as compared to the conventional drain recovery system 1 without the first condensing unit 33 and without the second condensing unit 39. The downsizing will be described in detail. In the closed drain recovery system, an amount of the drain that flows out the drain tank 4 (first drain amount) is determined based on load fluctuation of the steam boiler 2. Further, an amount of the drain that flows into the drain tank 4 (second drain amount) is determined based on load fluctuation of the loading apparatus 13.

However, as there is a temporal delay between the change in the first drain amount and the change in the second drain amount, when the load of the steam boiler 2 quickly decreases, the first drain amount quickly decreases while the second drain amount does not decrease. Therefore, it is not possible to store all of the drain in the drain tank 4, and the drain overflows. As described previously, when the drain overflows, a large amount of second flush steam is generated and heat of the flush steam is discarded into air, and a heat loss occurs in the case of the conventional system without the second condensing unit 39. In order to solve this problem, it is necessary to increase the content of the drain tank 4.

Further, the first flush steam is generated when the drain from the loading apparatus 13 flows into the drain tank 4, and if the content of the drain tank 4 is small, an amount of first flush steam released from the pressure relief line 10 increases. In the case of the conventional system without the first condensing unit 33, heat of the flush steam is discarded into air, and a heat loss occurs. In order to solve this problem, it is also necessary to increase the content of the drain tank 4.

However, according to this first embodiment, as the first condensing unit 33 and the second condensing unit 39 are provided and the first flush steam and the second flush steam are efficiently recovered, it is possible to suppress the heat loss without increasing the content of the drain tank 4, that is, with the downsized drain tank 4. Incidentally, a result of estimation under a certain condition is that assuming that the content of the drain tank 4 according to the first embodiment is 1 (e. g., 1000 L), the content of the drain tank 4 of the conventional system is 3.4 (e. g., 3400 L). According to this result of the estimation, it is possible to provide a significant effect that the content of the drain tank 4 of the system implementing the first embodiment may be smaller than that of the conventional system by 2.4 tanks of the drain tank 4. Further, by the downsizing, it is possible to reduce an area required for installing the system to a large extent.

Second Embodiment

Figure 11:
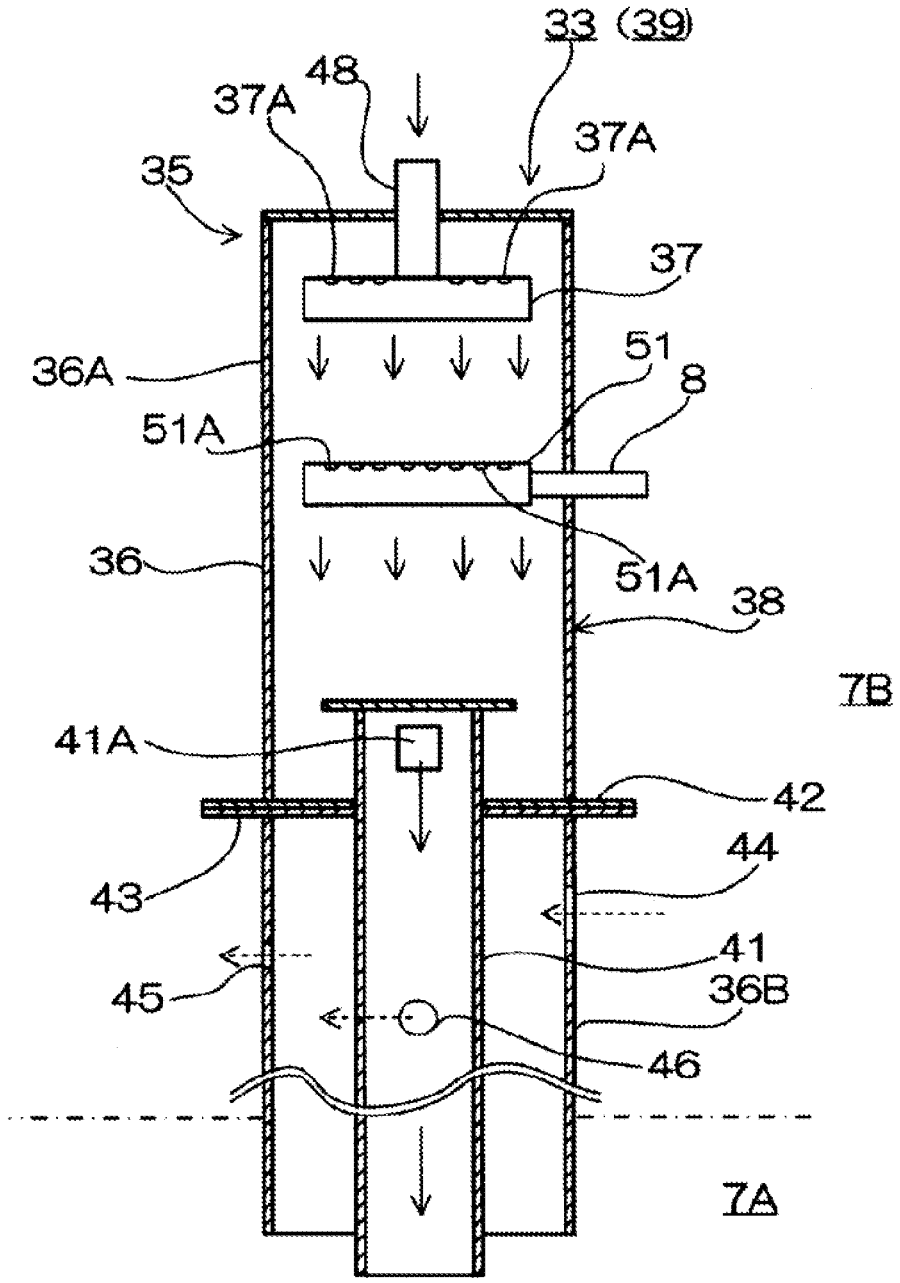
FIG. 11 is a general configuration diagram illustrating a section of a condensing unit of a second embodiment of the drain recovery system implementing the present invention.

The present invention is not limited to the first embodiment, and may employ the condensing units 33 and 39 as illustrated in FIG. 11. The second embodiment is different from the first embodiment only in that the contact heat exchange member 38A is omitted in the second embodiment, and that a second sprinkler 51 is provided in place of the connecting unit 40 under the first sprinkler 37. Similarly to the first sprinkler 37, the second sprinkler 51 is provided with a large number of spray holes 51A for spraying the drain upward like shower.

According to the second embodiment, by driving the circulation pump 47, as illustrated in FIG. 11, the makeup water sprayed from the sprinkler 37 falls downward as shown by a solid arrow in FIG. 11. On the other hand, the drain is sprayed from the spray holes 51A, and at this time, the drain is brought into contact with the liquid or the steam in the mixer 38 to generate the second flush steam. The second flush steam is filled in the mixer 38, and brought into contact with the falling mist-spray makeup water to be condensed. The condensed water and the drain that does not become the flush steam fall and are reserved at the inner bottom portion of the mixer 38, and then flow into the water introduction unit 41 through the water inlet 41A, and are introduced to the liquid phase unit 7A of the makeup water tank 7.

Third Embodiment

Figure 12:
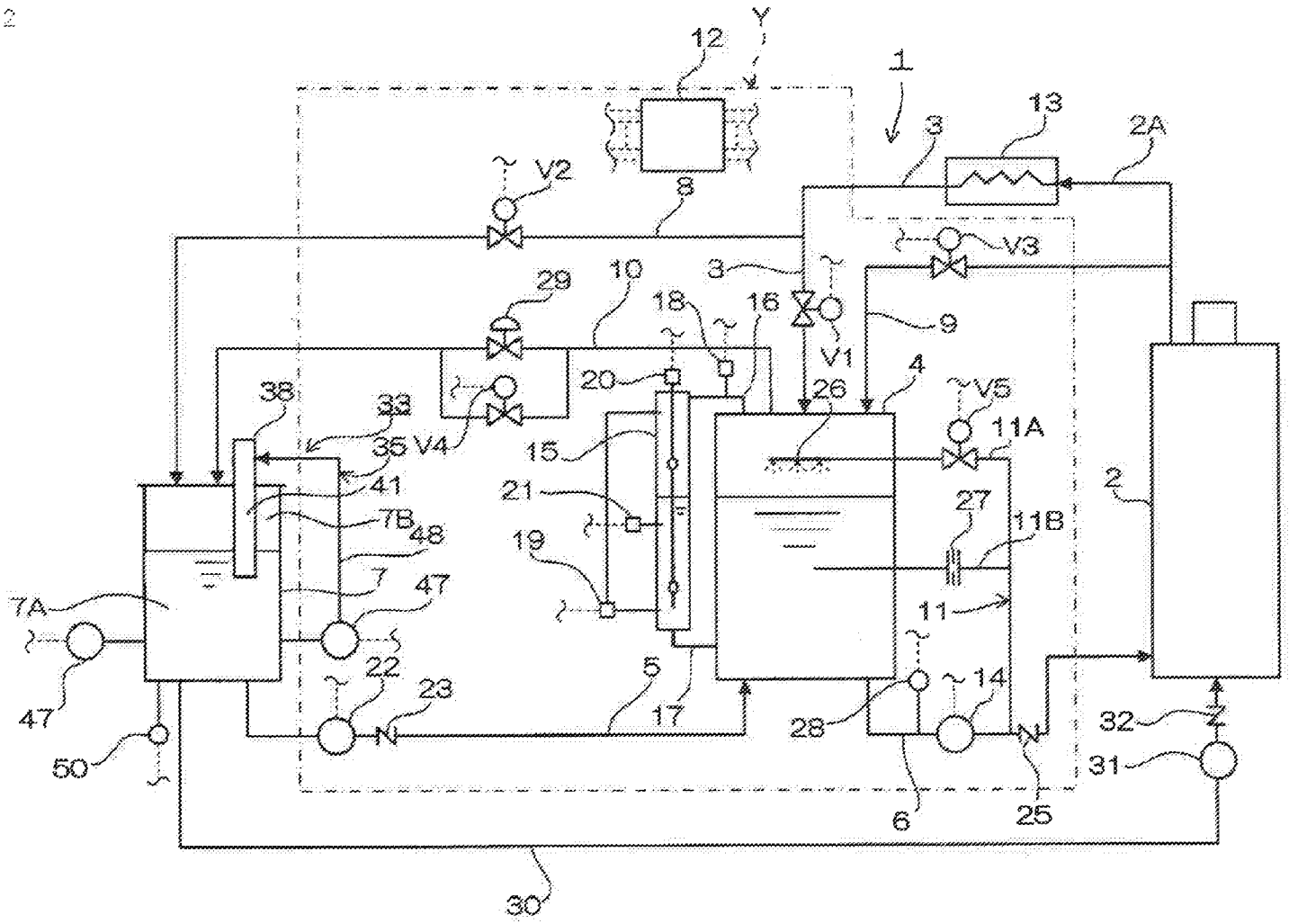
FIG. 12 is a general configuration diagram illustrating a third embodiment of the drain recovery system implementing the present invention.
Figure 13:
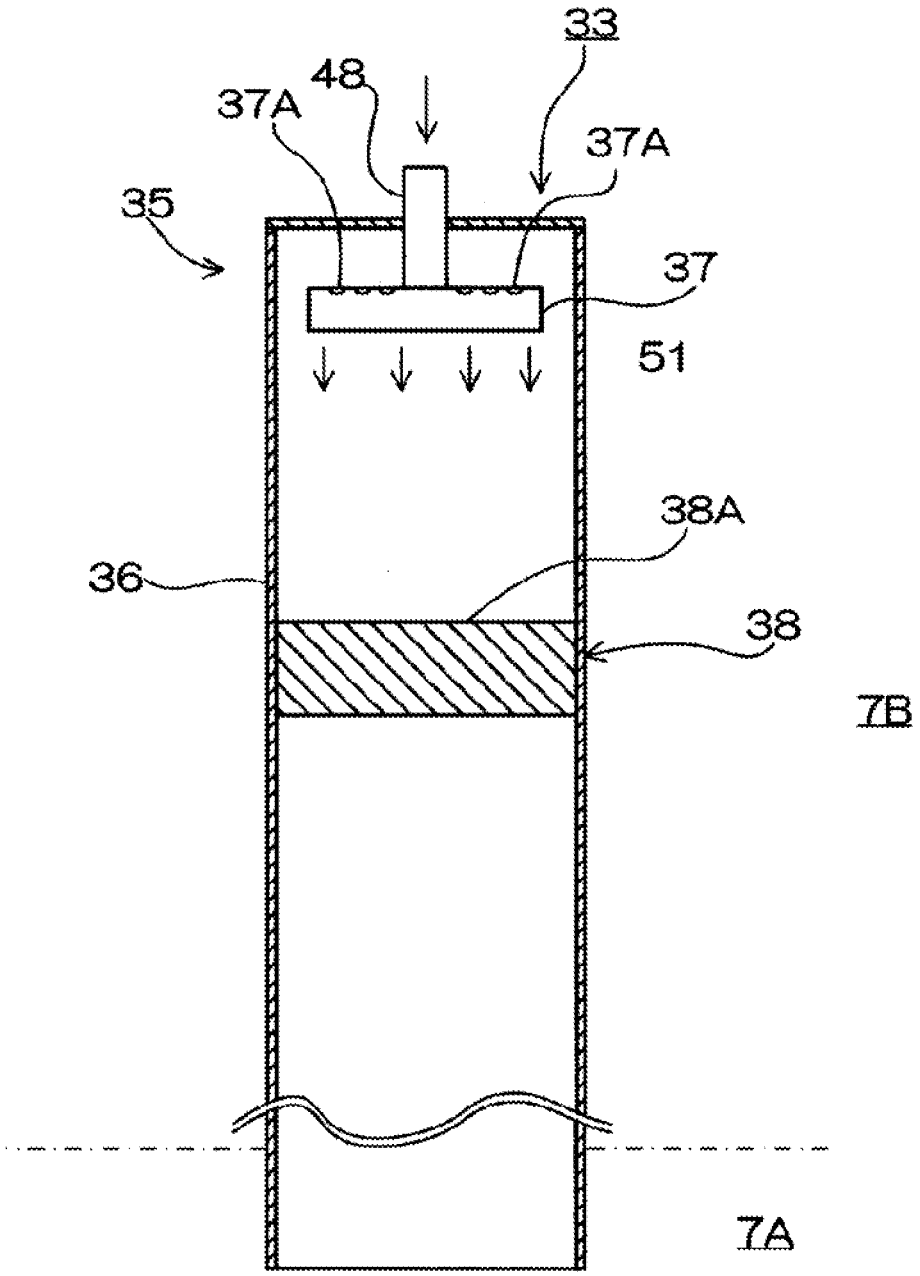
FIG. 13 is a general configuration diagram illustrating a section of a condensing unit of the third embodiment.

The present invention also includes a third embodiment illustrated in FIG. 12 and FIG. 13. The third embodiment provides a system configured to supply the first flush steam and the drain to the makeup water tank 7, instead of directly supplying the first flush steam and the drain to the mixer 38. Further, a condensing unit 33 illustrated in FIG. 13 is provided in place of the condensing units 33 and 39 according to the first embodiment. According to the third embodiment, similarly to the first embodiment, the contact heat exchange member 38A is provided below the sprinkler 37.

Fourth Embodiment

Figure 14:
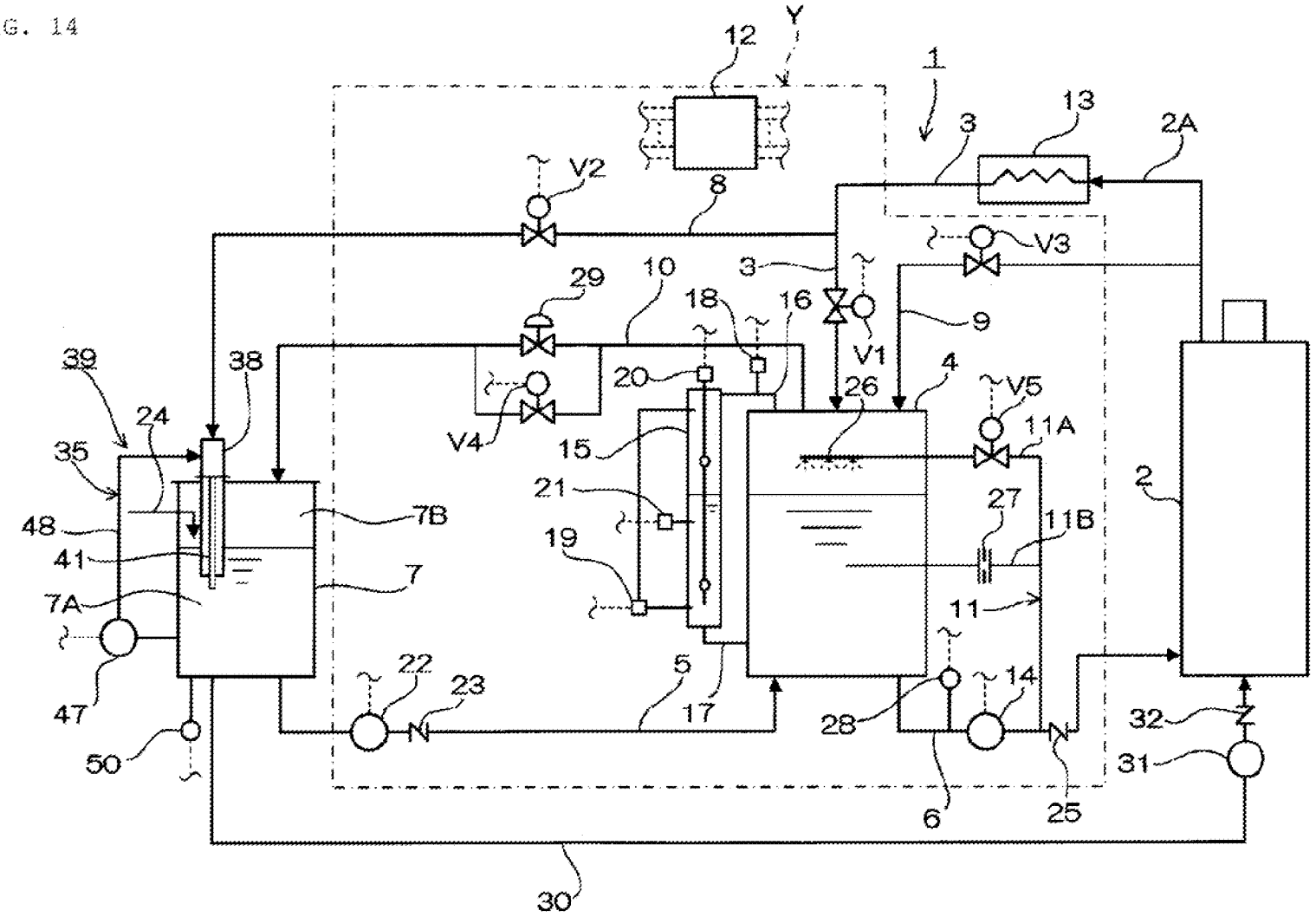
FIG. 14 is a general configuration diagram illustrating a fourth embodiment of the drain recovery system implementing the present invention.

Further, the present invention includes a system in which one of the first condensing unit 33 and the second condensing unit 39 is omitted. A fourth embodiment illustrated in FIG. 14 is not provided with the first condensing unit 33, but the rest of the configuration is the same as that of the first embodiment. Therefore, the same components are denoted by the same reference numerals and descriptions for these components are omitted.

Fifth Embodiment

Figure 15:
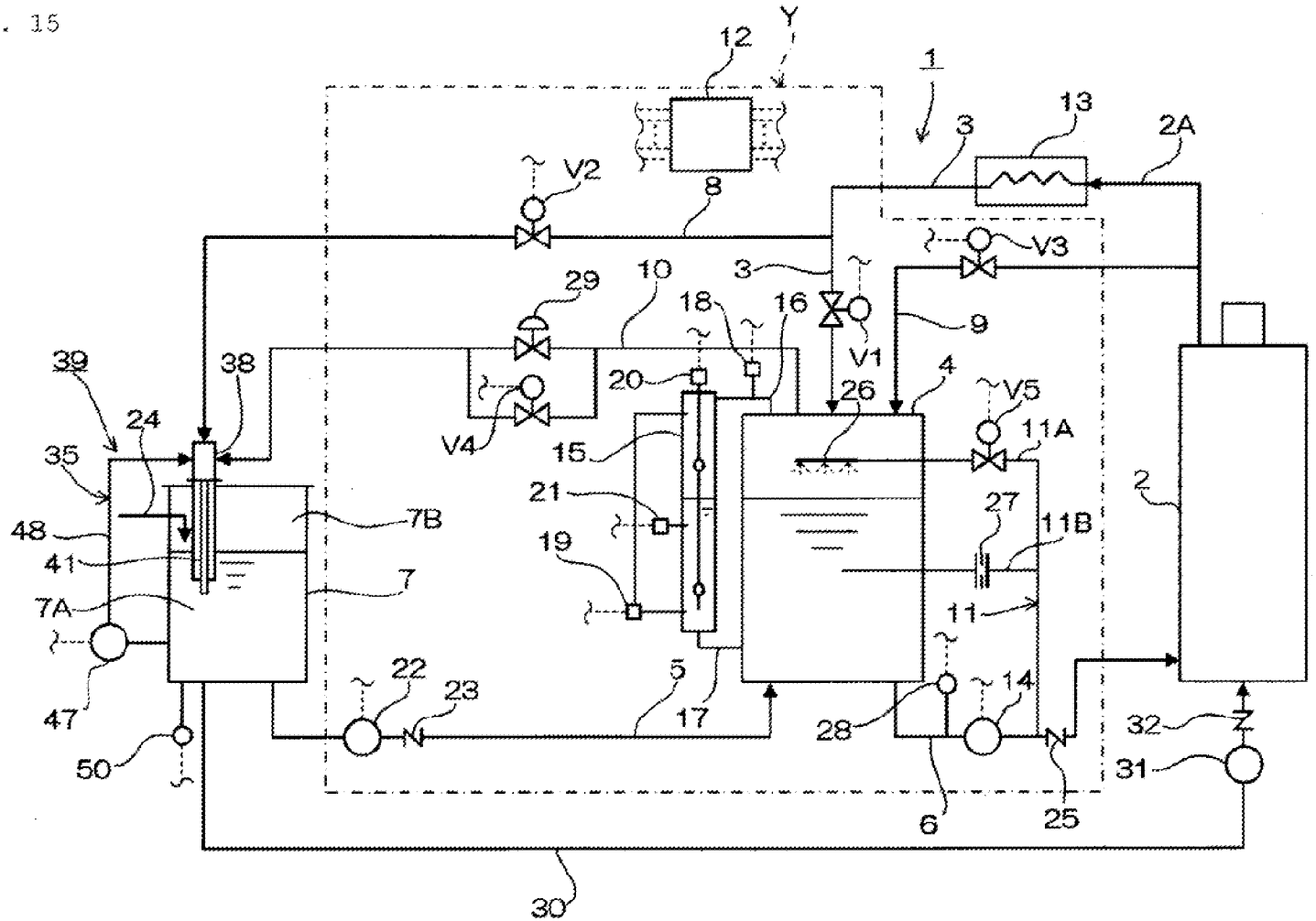
FIG. 15 is a general configuration diagram illustrating a fifth embodiment of the drain recovery system implementing the present invention.

Moreover, the present invention includes a system according to a fifth embodiment illustrated in FIG. 15, in which the first condensing unit 33 and the second condensing unit 39 are configured as a common component. In the fifth embodiment, the pressure relief line 10 is connected to the condensing unit 39 of the fourth embodiment illustrated in FIG. 14. In FIG. 15, a position at which the pressure relief line 10 is connected is the mixer 38 illustrated in FIG. 2, but may be the drain relief line 8. As the rest of the configuration is the same as that of the first embodiment, the same components are denoted by the same reference numerals and descriptions for these components are omitted.

Sixth Embodiment

Figure 16:
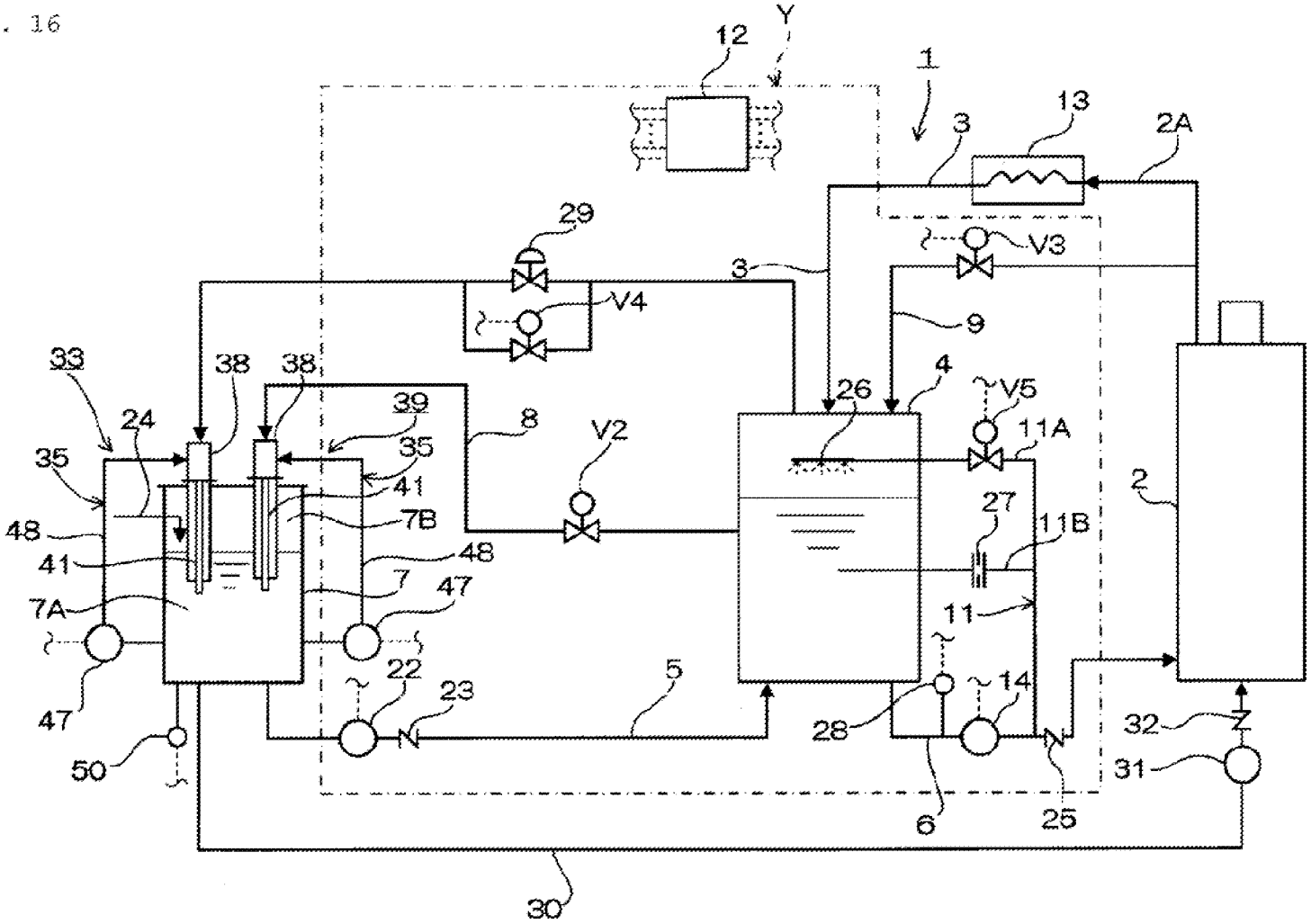
FIG. 16 is a general configuration diagram illustrating a sixth embodiment of the drain recovery system implementing the present invention.

Furthermore, the present invention includes a sixth embodiment illustrated in FIG. 16. Unlike the first embodiment having the direct surplus drain recovery means for introducing the drain from the drain return line 3 to the makeup water tank 7 without passing through the drain tank 4, the sixth embodiment includes indirect surplus drain recovery means for introducing the surplus drain to the makeup water tank 7 via the drain tank 4. The indirect surplus drain recovery means includes the drain relief line 8 and the second valve V2 provided for the drain relief line 8. The second valve V2 is normally closed, but opens in an occasion such as when the water level in the drain tank 4 exceeds the setting water level to introduce the surplus drain that cannot be stored to the makeup water tank 7.

Similarly to the first embodiment, the sixth embodiment also includes the first condensing unit 33 and the second condensing unit 39. An operation of the second condensing unit 39 of the sixth embodiment is basically the same as that of the second condensing unit 39 of the first embodiment, and different only in that the temperature and the pressure of the drain that flows into is low. Therefore, description for the operation shall be omitted.

REFERENCE SIGNS LIST

1: Drain Recovery System
2: Steam Boiler
3: Drain Return Line
4: Drain Tank
5: Makeup Water Line
6: Drain Supply Line
7: Makeup Water Tank
8: Drain Relief Line (Surplus Drain Introduction Line)
10: Pressure Relief Line (Steam Introduction Line)
12: Controller (Control Means)
13: Loading Apparatus
14: Drain Pump
33: First Condensing Unit
34: Mixer Means
35: Circulation Means
37: Sprinkler
38: Mixer
38A: Contact Heat Exchange Member
39: Second Condensing Unit
40: Connecting Unit (Steam Separator)
40B: Separating Plate
41: Water Introduction Unit
47: Circulation Pump
48: Circulation Line (Makeup Water Circulation Line)
V1: First Valve (Drain Return Valve)
V2: Second Valve (Drain Relief Valve)

The invention claimed is:

1. A closed drain recovery system comprising:

a steam boiler configured to supply steam to a loading apparatus;

a closed-type drain tank for reserving drain discharged from the loading apparatus through a drain return line, and configured to supply the reserved drain to the steam boiler through a drain supply line;

an air-open-type makeup water tank configured to supply makeup water to the drain tank through a makeup water line;

a steam introduction line for introducing a first flush steam within the drain tank to the makeup water tank;

a surplus drain introduction line for introducing surplus drain to the makeup water tank from one of the drain tank and the loading apparatus; and a condensing unit provided for the makeup water tank, and configured to condense one or both of the first flush steam and a second flush steam by bringing the one or both of the first flush steam and the second flush steam into contact with the makeup water within the makeup water tank, the second flush steam being generated from the surplus drain, wherein the condensing unit brings the makeup water into contact with the one or both of the first flush steam and the second flush steam while causing the makeup water to be circulated within the makeup water tank.

2. The closed drain recovery system according to claim 1, wherein the condensing unit includes mixer means and circulation means, the mixer means includes:

a sprinkler;

a mixer configured to condense the one or both of the first flush steam and the second flush steam by bringing the one or both of the first flush steam and the second flush steam into contact with the makeup water sprinkled from the sprinkler; and a water introduction unit configured to introduce the water condensed by the mixer into a liquid phase unit of the makeup water tank, and the circulation means includes:

a circulation pump; and a circulation line configured to introduce the makeup water at a bottom of the makeup water tank to the sprinkler.

3. The closed drain recovery system according to claim 2, wherein the mixer is provided with a contact heat exchange member for exchanging contact heat between the makeup water and the flush steam.

4. The closed drain recovery system according to claim 1, comprising:

the steam introduction line; and the surplus drain introduction line, wherein the condensing unit is provided for a connecting unit of the makeup water tank with the steam introduction line and the surplus drain introduction line.

5. The closed drain recovery system according to claim 1, comprising:

a first valve that is openable and closable and provided for the drain return line;

the surplus drain introduction line connected between the drain return line on an upstream side of the first valve and the makeup water tank; and a second valve that is openable and closable and provided for the surplus drain introduction line, wherein one of a first open-close state and a second open-close state is selectable, the first open-close state being a state in which the first valve is opened and the second valve is closed, the second open-close state being a state in which the first valve is closed and the second valve is opened, and the surplus drain is introduced into the makeup water tank in the second open-close state.

6. The closed drain recovery system according to claim 5, wherein the condensing unit provided for the surplus drain introduction line includes a steam separator disposed under the contact heat exchange member of the mixer, the steam separator being configured to separate steam by causing surplus drain that has flowed in to be hit against a separating plate.

* * * * *